US006826373B2

(12) United States Patent
Nomura

(10) Patent No.: US 6,826,373 B2
(45) Date of Patent: Nov. 30, 2004

(54) PROCESS CARTRIDGE, AN IMAGE FORMING APPARATUS, AND SYSTEM DESIGNED TO BLOCK ATTACHMENT OF A PROCESS CARTRIDGE TO AN APPARATUS FUNCTIONALLY DIFFERENT FROM THE APPARATUS TO WHICH THE PROCESS CARTRIDGE IS DESIGNED TO BE ATTACHED

(75) Inventor: Yoshiya Nomura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 10/091,286

(22) Filed: Mar. 6, 2002

(65) Prior Publication Data

US 2002/0131792 A1 Sep. 19, 2002

(30) Foreign Application Priority Data

Mar. 9, 2001 (JP) ..... 2001/066965
Feb. 21, 2002 (JP) ..... 2002/044641

(51) Int. Cl.[7] ..... G03G 15/00; G03G 21/16

(52) U.S. Cl. ..... 399/12; 399/111

(58) Field of Search ..... 399/13, 111, 114, 399/107, 118, 12

(56) References Cited

U.S. PATENT DOCUMENTS

| | | | | |
|---|---|---|---|---|
| 5,014,094 A | | 5/1991 | Amitani et al. | 355/326 |
| 5,294,960 A | | 3/1994 | Nomura et al. | |
| 5,331,373 A | | 7/1994 | Nomura et al. | |
| 5,345,294 A | | 9/1994 | Nomura et al. | |
| 5,452,056 A | | 9/1995 | Nomura et al. | |
| 5,455,665 A | | 10/1995 | Baba et al. | |
| 5,526,097 A | * | 6/1996 | Ream | 399/111 |
| 5,528,341 A | | 6/1996 | Shishido et al. | |
| 5,559,581 A | | 9/1996 | Sugiura et al. | |
| 5,561,496 A | | 10/1996 | Sugirua et al. | |
| 5,623,328 A | | 4/1997 | Tsuda et al. | 399/111 |
| 5,634,178 A | | 5/1997 | Sugiura et al. | 399/110 |
| 5,642,187 A | | 6/1997 | Nomura et al. | 399/111 |
| 5,650,841 A | | 7/1997 | Matsuda et al. | 399/111 |
| 5,678,139 A | | 10/1997 | Nomura et al. | 399/114 |
| 5,697,022 A | | 12/1997 | Matsuda et al. | 399/102 |
| 5,708,922 A | * | 1/1998 | Azuma et al. | 399/111 |
| 5,787,323 A | | 7/1998 | Nomura et al. | 399/111 |
| 5,825,472 A | | 10/1998 | Araki et al. | |
| 5,828,928 A | | 10/1998 | Sasago et al. | 399/111 |
| 5,839,028 A | | 11/1998 | Nomura et al. | 399/109 |
| 5,907,751 A | | 5/1999 | Kawaguchi et al. | 399/117 |

(List continued on next page.)

FOREIGN PATENT DOCUMENTS

| | | | | |
|---|---|---|---|---|
| JP | 59031976 A | * | 2/1984 | G03G/15/01 |
| JP | 8-179626 | | 7/1996 | |
| JP | 2000-147413 | | 5/2000 | |

*Primary Examiner*—Susan S. Y. Lee
(74) *Attorney, Agent, or Firm*—Fitzpatrick, Cella, Harper & Scinto

(57) ABSTRACT

A process cartridge is detachably attachable to the main body of an electrophotographic image forming apparatus having a laser beam applying member, a shutter for shutting off the optical path of a laser beam emitted from the laser beam applying member, a portion for moving the shutter to a retracted position retracted from a shutting-off position for shutting off the optical path, a main body frame provided upstream of the shutter with respect to the attachment direction of the process cartridge, and an opening portion provided in the main body frame. The cartridge includes an electrophotographic photosensitive drum, a process device for acting on the drum, and a cartridge abutting portion adapted, when the cartridge is to be attached to the main body of an apparatus functionally differing from the main body of the image forming apparatus, to abut against a main body frame provided on the main body of the functionally different apparatus to thereby block the attachment of the process cartridge.

31 Claims, 14 Drawing Sheets

U.S. PATENT DOCUMENTS 5,983,054 A * 11/1999 Kameyama ..... 399/107
6,029,031 A 2/2000 Yokomori et al. ..... 399/109
6,064,843 A 5/2000 Isobe et al. ..... 399/111
6,072,968 A 6/2000 Nomura et al. ..... 399/113
6,084,622 A 7/2000 Sugiura et al. ..... 347/170
6,201,935 B1 3/2001 Terada et al. ..... 399/13
6,208,816 B1 3/2001 Koizumi et al. ..... 399/27
6,215,969 B1 4/2001 Nomura et al. ..... 399/111
6,473,155 B1 * 10/2002 Kim ..... 399/114

* cited by examiner

PROCESS CARTRIDGE, AN IMAGE FORMING APPARATUS, AND SYSTEM DESIGNED TO BLOCK ATTACHMENT OF A PROCESS CARTRIDGE TO AN APPARATUS FUNCTIONALLY DIFFERENT FROM THE APPARATUS TO WHICH THE PROCESS CARTRIDGE IS DESIGNED TO BE ATTACHED

BACKGROUND OF THE INVENTION

Field of the Invention and Related Art

This invention relates to a process cartridge detachably attachable to the main body of an electrophotographic image forming apparatus, an image forming apparatus and an image forming system. Here, the process cartridge refers to electrifying means, developing means or cleaning means as process means and an electrophotographic photosensitive member integrally made into a cartridge which is made detachably attachable to the main body of the image forming apparatus. Or it refers to at least one of electrifying means, developing means and cleaning means as process means and an electrophotographic photosensitive member integrally made into a cartridge which is made detachably attachable to the main body of the image forming apparatus. Further, it refers to at least developing means as process means and an electrophotographic photosensitive member integrally made into a cartridge which is made detachably attachable to the main body of the image forming apparatus.

Also, the term "electrophotographic image forming apparatus" covers, for example, an electrophotographic copying machine, an electrophotographic printer (such as an LED printer or a laser beam printer), an electrophotographic facsimile apparatus and an electrophotographic word processor.

In an image forming apparatus using the electrophotographic image forming process, there has heretofore been adopted a process cartridge system in which an electrophotographic photosensitive member and process means for acting on the electrophotographic photosensitive member are integrally made into a cartridge which is made detachably attachable to the main body of the image forming apparatus. According to this process cartridge system, the maintenance of the apparatus can be done by a user himself without resort to a serviceman and therefore, the operability of the apparatus could be markedly improved. So, this process cartridge system is widely used in image forming apparatuses.

The developing apparatus of this process cartridge has a toner container which is a developer container for containing therein a toner which is a developer, and a developing chamber provided with a developing roller which is a developer carrying member. When the toner in the toner container is used up, the process cartridge needs be interchanged with a new one.

Also, in recent years, the digitization of copying machines and the use of plain paper in facsimile machine have advanced and a laser beam printer, a copying machine and a facsimile apparatus are sometimes constituted by a common printer portion. Products having these common printers need to have their functions changed a little depending on the ways of use of the respective products. For example, in the laser beam printer and copying machine, even if there is not the detection of the remaining amount of toner, the process cartridge can be interchanged at a point in time at which the toner in the toner container has become null and an image has become thin or blurred, and this does not become a great impediment. In the facsimile apparatus, however, there is a way of use, such as reception in the nighttime or the like, and therefore, if the apparatus is left in a state in which the toner in the toner container is about to become null, a thin output which is illegible may be put out. Consequently, a toner remaining amount apparatus for detecting the remaining amount of toner is requisite. Also, many copying machines that have been digitized in recent years also have the fax function and in this case, the toner remaining amount detecting apparatus becomes necessary even in the copying machines.

The above-mentioned toner remaining amount detecting apparatus is provided with a metallic antenna rod provided in a path leading from the toner container to a developing roller in the developing chamber in parallel to the lengthwise direction of the developing roller. A voltage is applied to between this antenna rod and the developing roller and the capacitance between the two is measured, whereby the remaining amount of toner can be detected. A predetermined threshold value is provided, and when the detected capacitance becomes lower than the threshold value, it can be known that the toner between the two is small, that is, the amount of toner in the container is small. In this manner, changes in the capacitance are detected to thereby detect the exhaustion of the toner.

As regards process cartridges for use in a group of such products, the ones for use in the facsimile apparatuses need have the toner remaining amount detecting function attached thereto, and the ones for the others need not have the toner remaining amount detecting function. Therefore, two kinds of process cartridges had to be prepared. These two kinds of process cartridges must be non-interchangeable with each other. Therefore, it would occur to one's mind to provide convex and concave shapes on respective frames, and provide a concavity and a convexity at corresponding locations on the main body of the image forming apparatus.

SUMMARY OF THE INVENTION

It is an object of the present invention to provide a process cartridge, an electrophotographic image forming apparatus and an electrophotographic image forming system which can prevent a process cartridge from being wrongly attached to the main body of a functionally different electrophotographic image forming apparatus.

It is another object of the present invention to provide a process cartridge, an electrophotographic image forming apparatus and an electrophotographic image forming system in which a cartridge abutting portion provided on a process cartridge has both of the function of moving a laser shutter to a retracted position for opening a laser optical path and the function of preventing the process cartridge from being wrongly attached to the main body of a functionally different image forming apparatus.

It is another object of the present invention to provide a process cartridge, an electrophotographic image forming apparatus and an electrophotographic image forming system provided with a cartridge abutting portion which enables an operator to visually confirm wrong attachment when he tries to attach a process cartridge to a functionally different electrophotographic image forming apparatus.

It is another object of the present invention to provide a process cartridge, an electrophotographic image forming apparatus and an electrophotographic image forming system which have realized non-interchangeability by a simple construction like a projection protruded upwardly from the cleaning frame of the process cartridge.

It is another object of the present invention to provide a process cartridge detachably attachable to the main body of an electrophotographic image forming apparatus having a laser beam applying member, a shutter for shutting off the optical path of a laser beam emitted from the laser beam applying member, a main body abutting portion for moving the shutter to a retracted position retracted from a shutting-off position for shutting off the optical path, a main body frame provided upstream of the shutter with respect to the attachment direction of the process cartridge, and an opening portion provided in the main body frame, the process cartridge having:

an electrophotographic photosensitive drum;

process means for acting on the electrophotographic photosensitive drum; and a process cartridge abutting portion adapted, when the process cartridge is to be attached to the main body of an electrophotographic image forming apparatus functionally differing from the main body of the image forming apparatus, to abut against a main body frame provided on the main body of the functionally different image forming apparatus to thereby block the attachment of the process cartridge, and when the process cartridge is to be attached to the main body of the image forming apparatus, to pass through the opening portion and abut against the main body abutting portion to thereby move the shutter to the retracted position.

It is another object of the present invention to provide an electrophotographic image forming apparatus for permitting one of a plurality of process cartridges to be detachably attached thereto and forming an image on a recording medium, comprising:

(i) a laser beam applying member;

(ii) a shutter for shutting off the optical path of a laser beam emitted from the laser beam applying member;

(iii) a main body abutting portion for moving the shutter to a retracted position retracted from a position for shutting off the optical path;

(iv) a main body frame provided upstream of the shutter with respect to the attachment direction of the process cartridge;

(v) an opening portion provided in the main body frame;

(vi) a cleaning frame, an electrophotographic photosensitive drum supported by the cleaning frame, an exposure opening formed in the cleaning frame to apply the laser beam to the electrophotpgraphic photosensitive drum, and a cartridge abutting portion protruding upwardly from the cleaning frame with the process cartridge attached to the main body of the apparatus, and provided on one end portion of the exposure opening in the axial direction of the photosensitive drum, the cartridge abutting portion being adapted, when the process cartridge is to be attached to the main body of an electrophotographic image forming apparatus functionally differing from the main body of the image forming apparatus, to abut against a main body frame provided on the functionally different main body to thereby block the attachment of the process cartridge, and when the process cartridge is to be attached to the main body, to pass through the opening portion and abut against the main body abutting portion, whereby when the process cartridge is attached to the main body, the corner and upper portion of the distal end of the cartridge abutting portion abuts against the main body abutting portion to thereby move the shutter to the retracted position; and (vii) conveying means for conveying the recording medium.

It is another object of the present invention to provide an electrophotographic image forming system for attaching a process cartridge to the main body of an electrophotographic image forming apparatus, and forming an image on a recording medium, the main body of the image forming apparatus comprising:

a laser beam applying member;

a shutter for shutting off the optical path of a laser beam emitted from the laser beam applying member;

a main body abutting portion for moving the shutter to a retracted position retracted from a shutting-off position for shutting off the optical path;

a main body frame provided upstream of the shutter with respect to the attachment direction of the process cartridge;

an opening portion provided in the main body frame;

attaching means for detachably attaching the process cartridge; and conveying means for conveying the recording medium;

the process cartridge comprising:

an electrophotographic photosensitive drum;

process means for acting on the electrophotographic photosensitive drum; and a cartridge abutting portion adapted, when the process cartridge is to be attached to the main body of an electrophotographic image forming apparatus functionally differing from the main body of the image forming apparatus, to abut against a main body frame provided on the functionally different main body of the image forming apparatus to thereby block the attachment of the process cartridge, and when the process cartridge is to be attached to the main body of the image forming apparatus, to pass through the opening portion and abut against the main body abutting portion to thereby move the shutter to the retracted position;

wherein when the process cartridge is to be attached to the main body of the electrophotographic image forming apparatus functionally differing from the image forming apparatus, the main body frame provided on the functionally different main body of the image forming apparatus and the cartridge abutting portion abut against each other to thereby block the attachment of the process cartridge, and when the process cartridge is to be attached to the attaching means, the cartridge abutting portion passes through the opening portion and abuts against the main body abutting portion to thereby move the shutter to the retracted position.

BRIEF DESCRIPTION OF THE DRAWINGS

Some embodiments of the present invention are shown in the drawings, wherein.

DESCRIPTION OF THE PREFERRED EMBODIMENTS

Figure 1:
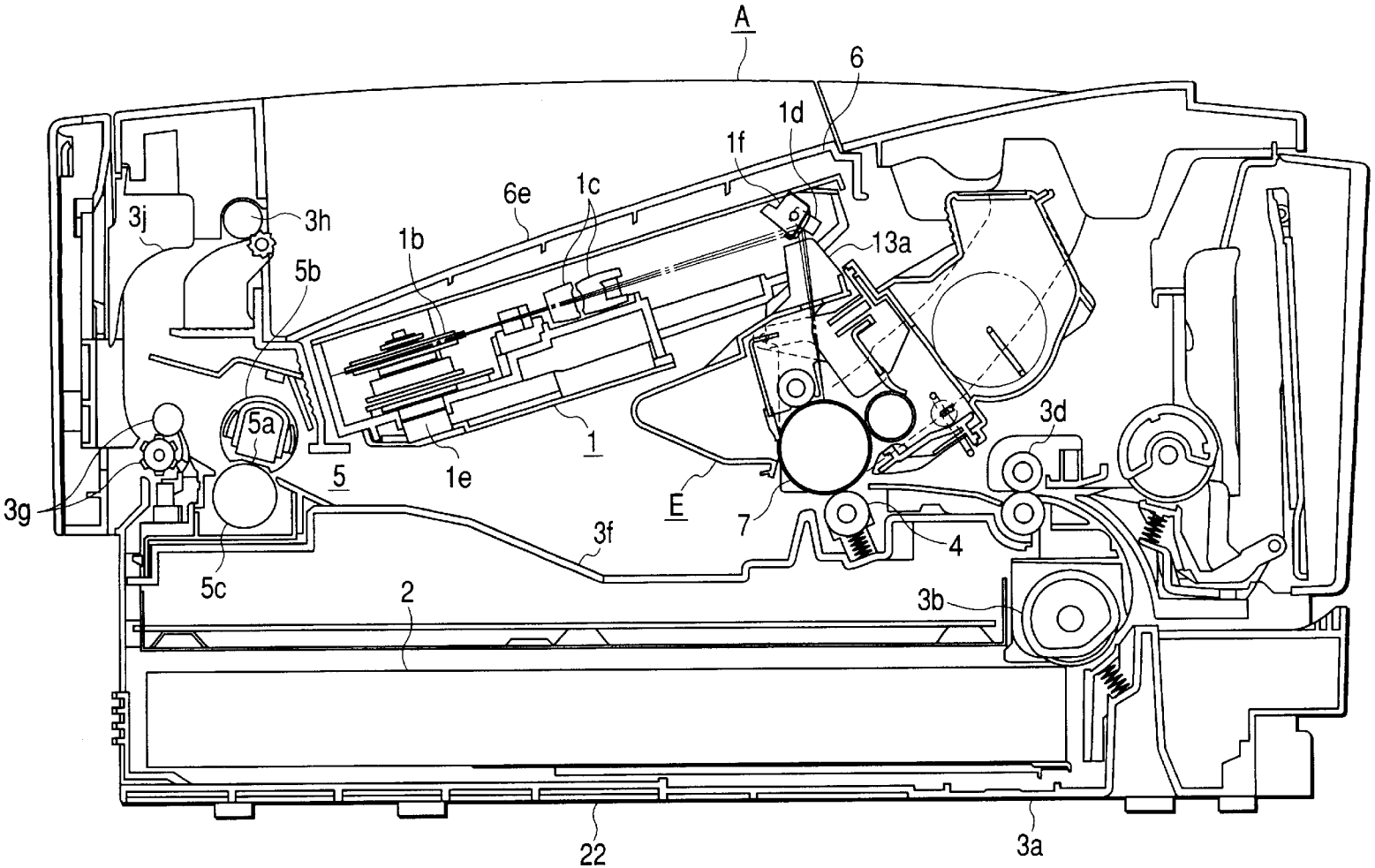
FIG. 1 is a longitudinal cross-sectional view of an image forming apparatus.
Figure 2:
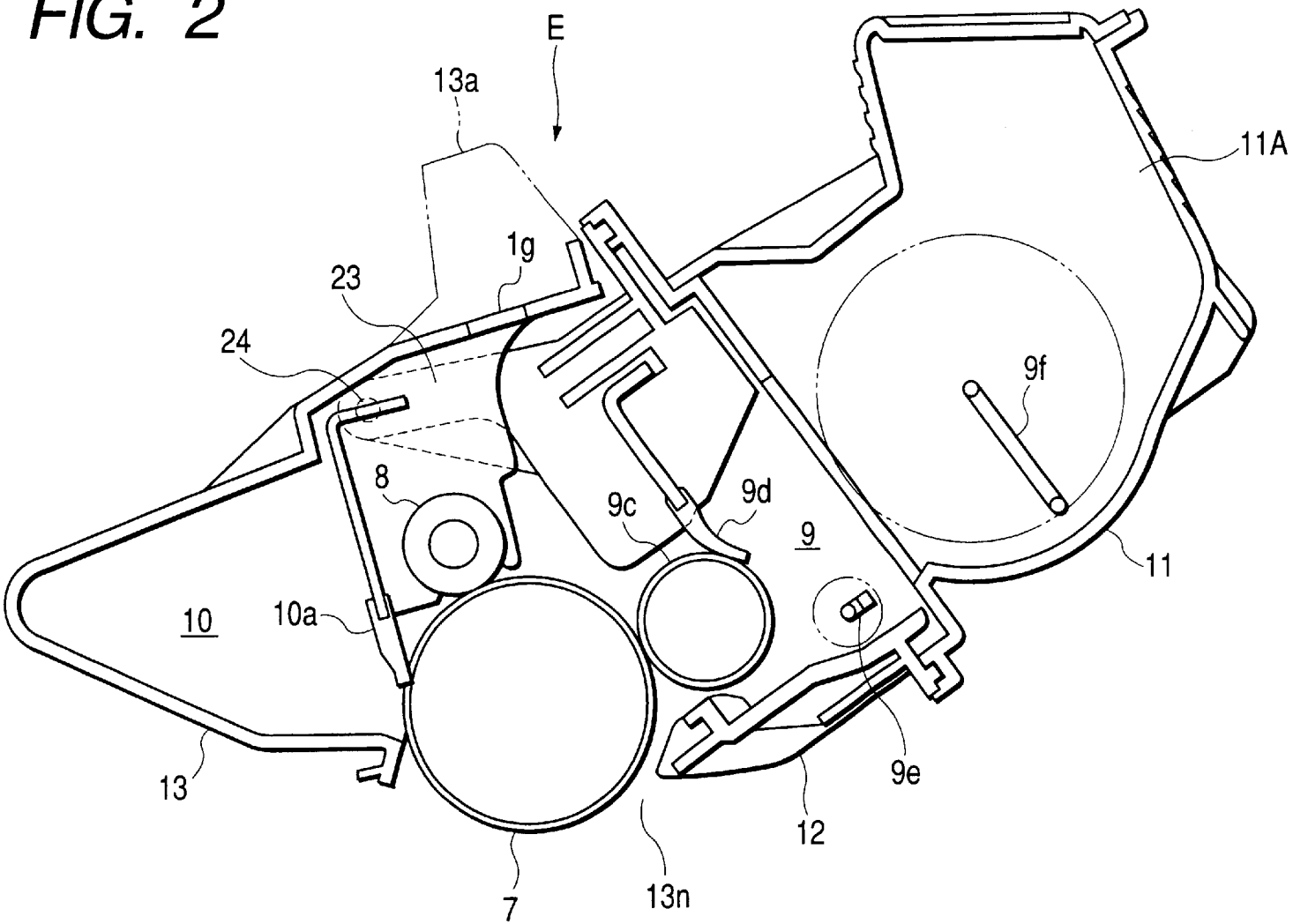
FIG. 2 is a longitudinal cross-sectional view of a process cartridge.

Reference is first had to FIGS. 1 and 2 to describe a laser beam printer A as an electrophotographic image forming apparatus to which Embodiment 1 of the present invention is applied.

This laser beam printer A, as shown in FIG. 1, forms an image on a recording medium (such as recording paper, an OHT sheet or cloth) by the electrophotographic image forming process. It forms a toner image on a drum-shaped electrophotographic photosensitive member (hereinafter referred to as the photosensitive drum). Specifically, electrification is effected on the photosensitive drum by electrifying means, and then a laser beam conforming to an image state is applied to the photosensitive drum to thereby form a latent image thereon. This latent image is then developed by developing means to thereby form a toner image. In synchronism with the formation of the toner image, a recording medium 2 set on a sheet feeding cassette 3*a* is reversal-conveyed by a pickup roller 3*b* and a pair of registration rollers 3*d*. The toner image formed on the photosensitive drum 7 of a process cartridge E is transferred to the recording medium 2 by a voltage being applied to a transferring roller 4 as transferring means. Thereafter, the recording medium 2 to which the toner image has been transferred is conveyed to fixing means 5 by a conveying guide 3*f*. This fixing means 5 has a driving roller 5*c* and a fixing rotary member 5*b* containing a heater 5*a* therein. Heat and pressure are applied to the recording medium 2 as it passes the fixing means 5, thereby fixing the transferred toner image. This recording medium 2 is conveyed by discharge rollers 3*g* and 3*h* and is discharged onto the sheet discharging tray 6*e* of a main body frame 6 through a reversing path 3*j*.

The optical means 1 is made into a unit as a laser scanner having a laser diode (not shown), a polygon mirror 1*b*, a lens 1*c*, a reversing mirror 1*d* and a scanner motor 1*e*. Also, the laser scanner 1 has a laser shutter 1*f* disposed at the exit of the laser beam. The laser shutter 1*f* is designed to be pivotally moved to two positions for intercepting and passing the laser beam.

Figure 3:
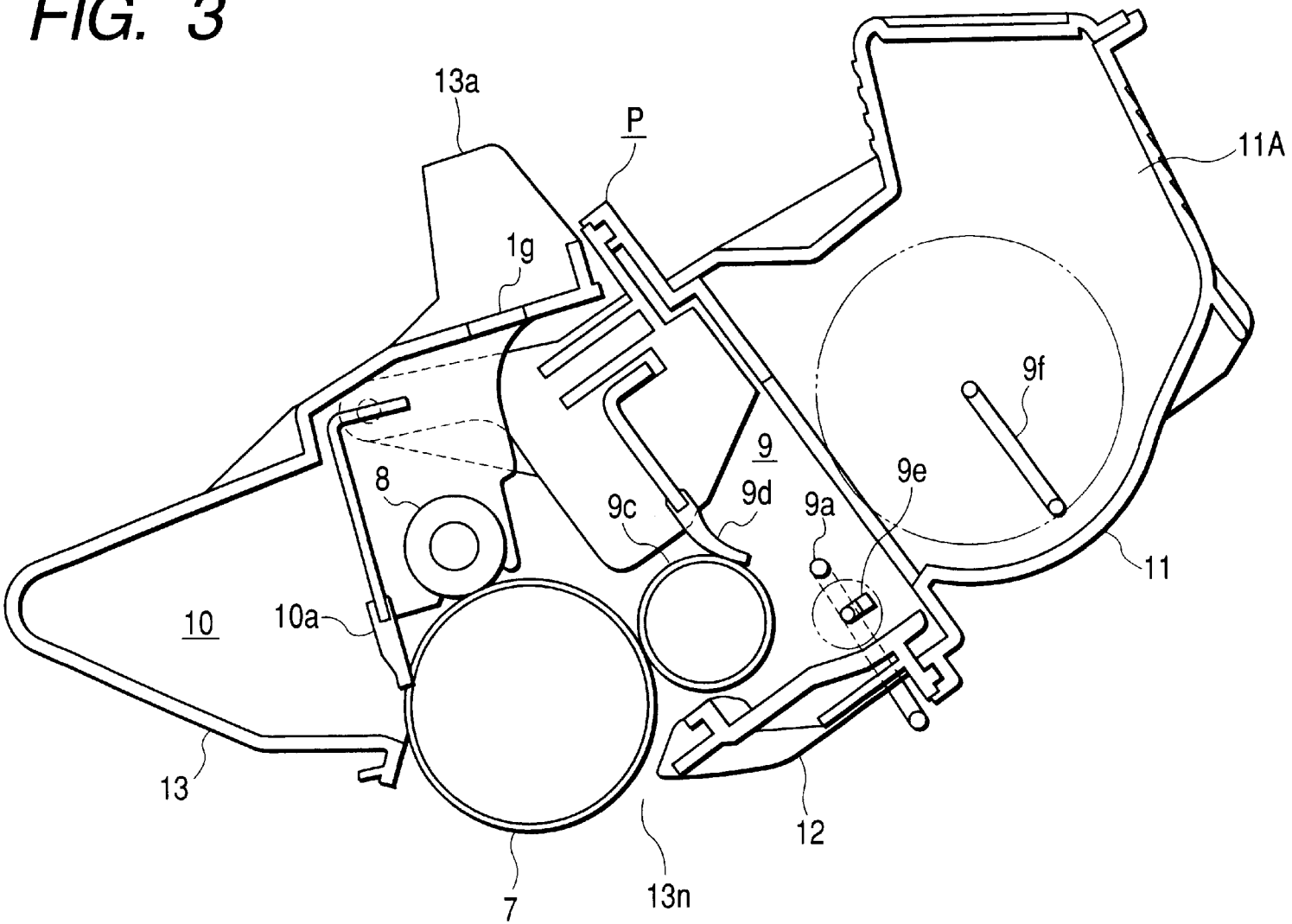
FIG. 3 is a longitudinal cross-sectional view of the process cartridge.

On the other hand, in the process cartridge E, as shown in FIGS. 2 and 3, the photosensitive drum 7 having a photosensitive layer is rotated and the surface thereof is uniformly electrified by the application of a voltage to an electrifying roller 8 which is electrifying means. A laser beam conforming to image information from the optical means 1 is applied to the photosensitive drum 7 through an exposure opening portion 1*g* to thereby form a latent image. This latent image is developed by developing means 9 by the use of a toner. That is, the electrifying roller 8 is provided in contact with the photosensitive drum 7 and effects electrification on the photosensitive drum 7. This electrifying roller 8 is driven to rotate by the photosensitive drum 7. Also, the developing means 9 supplies the toner to the developing area of the photosensitive drum 7 to thereby develop the latent image formed on the photosensitive drum 7.

The developing means 9 feeds the toner in a toner container 11A to a developing roller 9*c* by the rotation of a toner feeding member 9*f*. A developing roller 9*c* containing a stationary magnet therein is rotated and a toner layer having had triboelectrification charges induced therein by a developing blade 9*d* is formed on the developing roller, and that toner is shifted to the photosensitive drum 7 to thereby form a visible toner image. The developing blade 9*d* prescribes the amount of toner on the peripheral surface of the developing roller 9*c* and also induces triboelectrification charges. A toner agitating member 9*e* for circulating the toner in a developing chamber is rotatably mounted near the developing roller 9*c*.

The process cartridge E is constructed by coupling a toner frame (frame) 11 having a toner container (toner containing portion) 11A containing the toner therein and a developing frame (frame) 12 holding the developing means 9 such as the developing roller 9*c* to each other, and coupling thereto a cleaning frame (frame) 13 having attached thereto the photosensitive drum 7, cleaning means 10 such as a cleaning blade 10*a*, and the electrifying roller 8.

This process cartridge E is detachably attachable to the main body 22 of the image forming apparatus by an operator. The attachment and detachment of the process cartridge to and from the main body 22 of the image forming apparatus are accomplished by upwardly opening an openable and closable member 35 about a hinge 35*a* and attaching the process cartridge in the direction of arrow X in FIG. 4, and detaching it in a direction opposite to the direction of arrow X.

Figure 4:
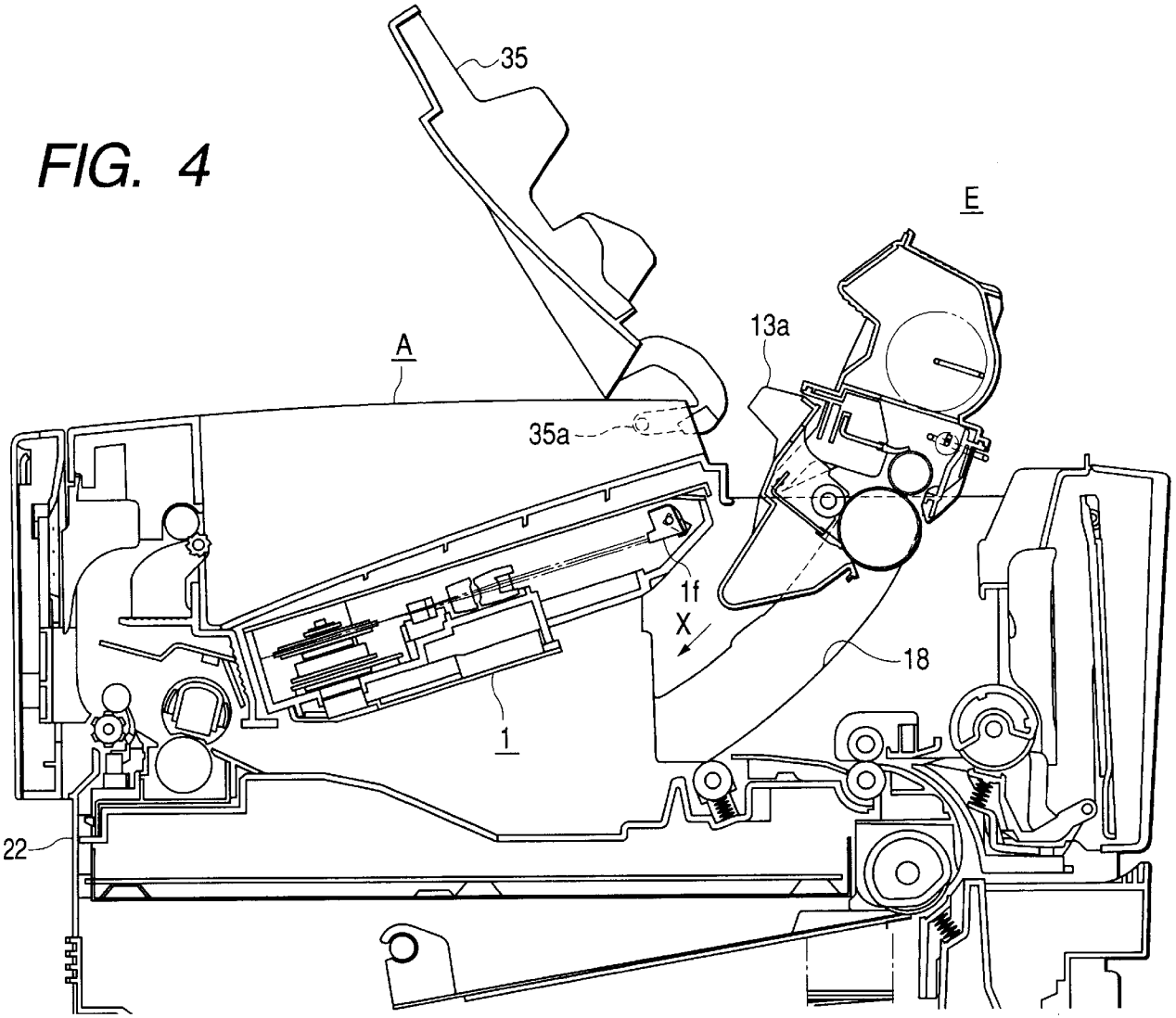
FIG. 4 is a longitudinal cross-sectional view for illustrating how to attach the process cartridge to the image forming apparatus.
Figure 8:
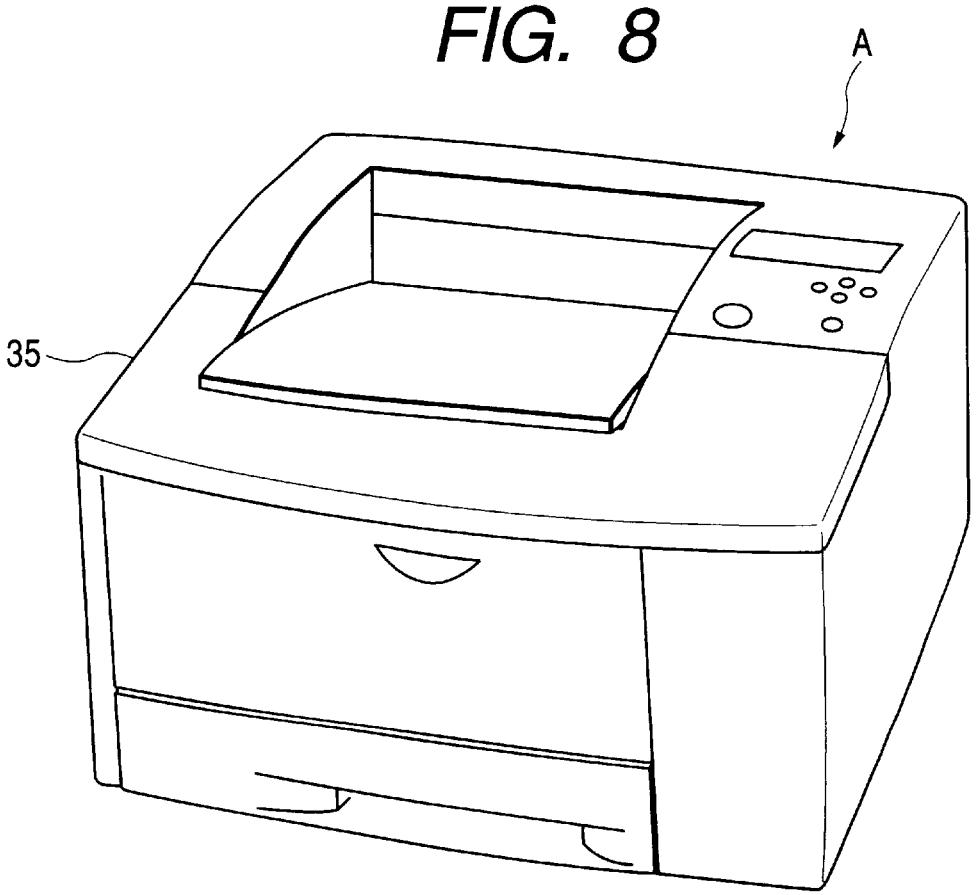
FIG. 8 is a perspective view of a printer.
Figure 9:
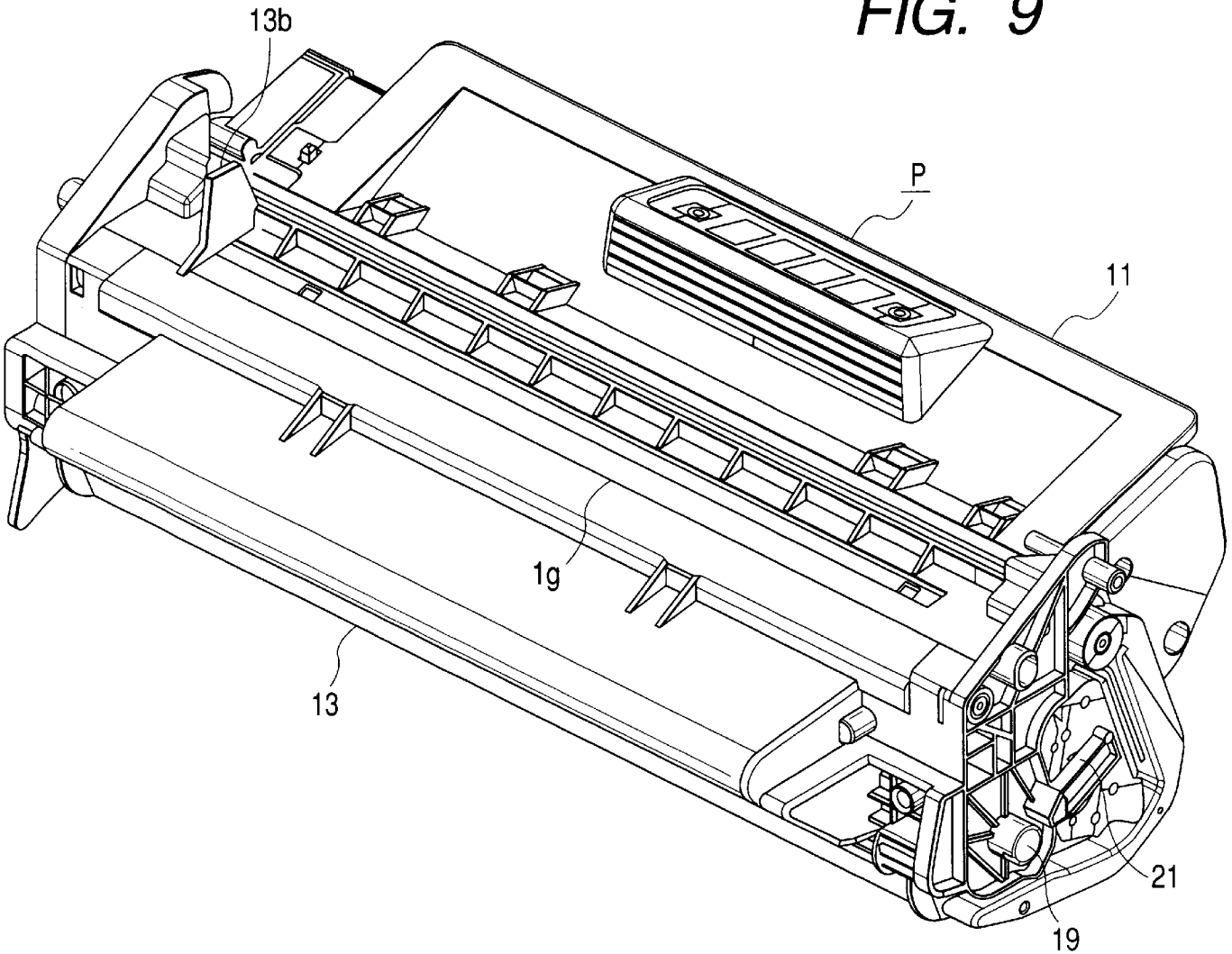
FIG. 9 is a perspective view of the process cartridge.
Figure 10:
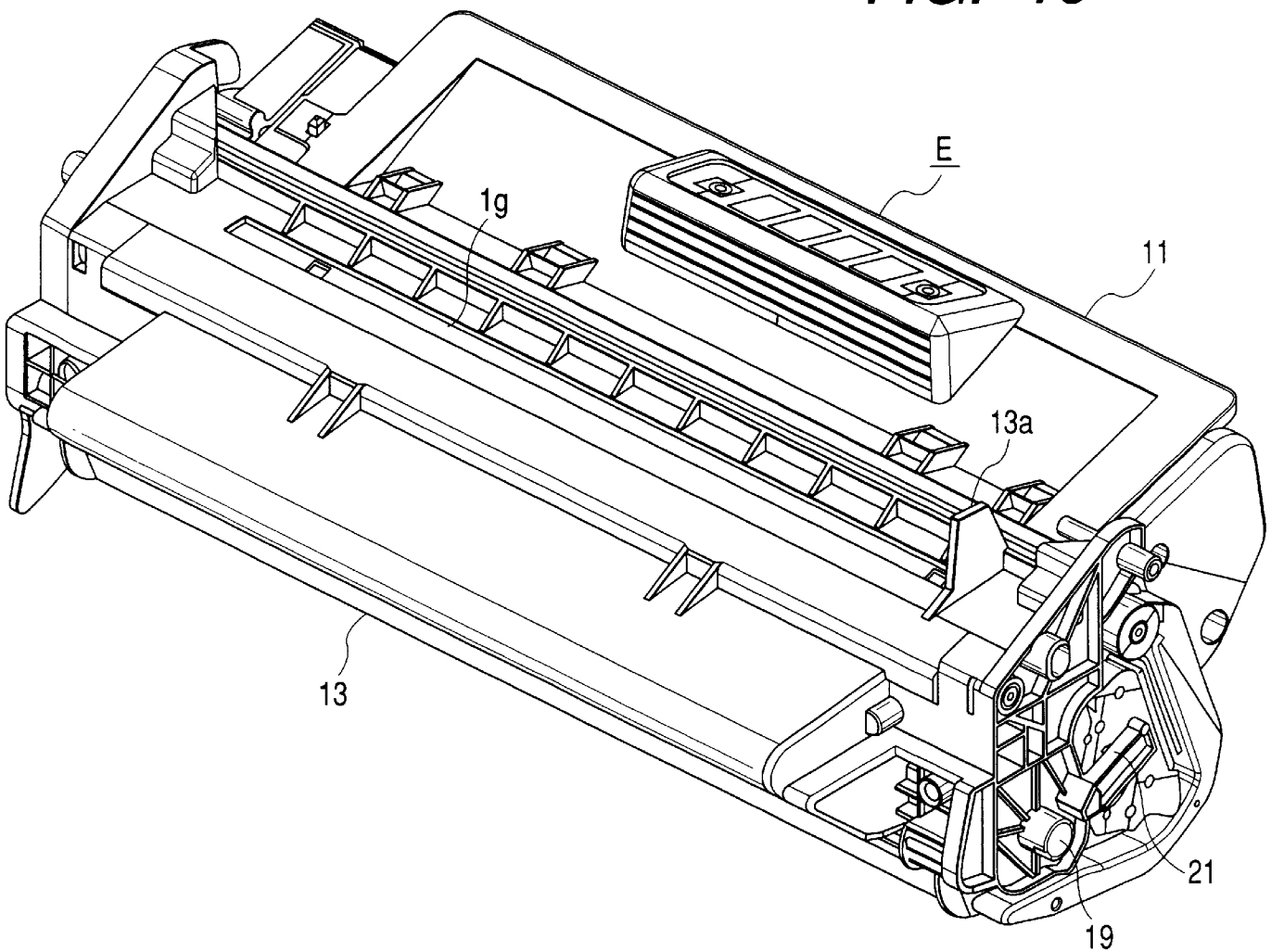
FIG. 10 is a perspective view of the process cartridge.

As shown in FIG. 4, guide members are disposed on the right and left inner walls of the main body of the apparatus as viewed in the attachment direction of the process cartridge, and a guide rail 18 is forwardly downwardly provided. On the other hand, as shown in FIGS. 9 and 10, the process cartridges P and E are the same except for the locations of projections 13*a* and 13*b*, and a cylindrical positioning boss 19 is provided on the axis of the photosensitive drum 7. An elongate posture determining guide 21 is provided rearwardly of the boss 19 as viewed in the insertion direction of the process cartridges P and E. So, the positioning boss 19 and the posture determining guide 21 are fitted to the guide rail 18 to thereby attach or detach the process cartridges P and E to or from the main body of the apparatus. Such an attaching portion of the process cartridge is common to a facsimile apparatus C having a facsimile function in a laser beam printer shown in FIG. 5, a copying apparatus B shown in FIG. 6, and a laser beam printer A shown in FIG. 8, and a process cartridge having no projection for operating the laser shutter 1*f* could be attached to any of the image forming apparatuses A, B and C, but could not effect exposure.

The process cartridge E is provided with the exposure opening portion 1*g* for applying therethrough light conforming to the image information to the photosensitive drum 7, and a transfer opening portion 13*n* for opposing the photosensitive drum 7 to the recording medium 2. Specifically, the exposure opening portion 1*g* is provided in the cleaning frame 13. The projection 13*a* is disposed on one end portion (right end portion) of the exposure opening portion 1*g* in the axial direction of the photosensitive drum. The projection 13*a* is of a rib shape having a rectangular cross section. Also, the projection 13*a* is formed by being molded integrally with the cleaning frame 13.

Figure 13:
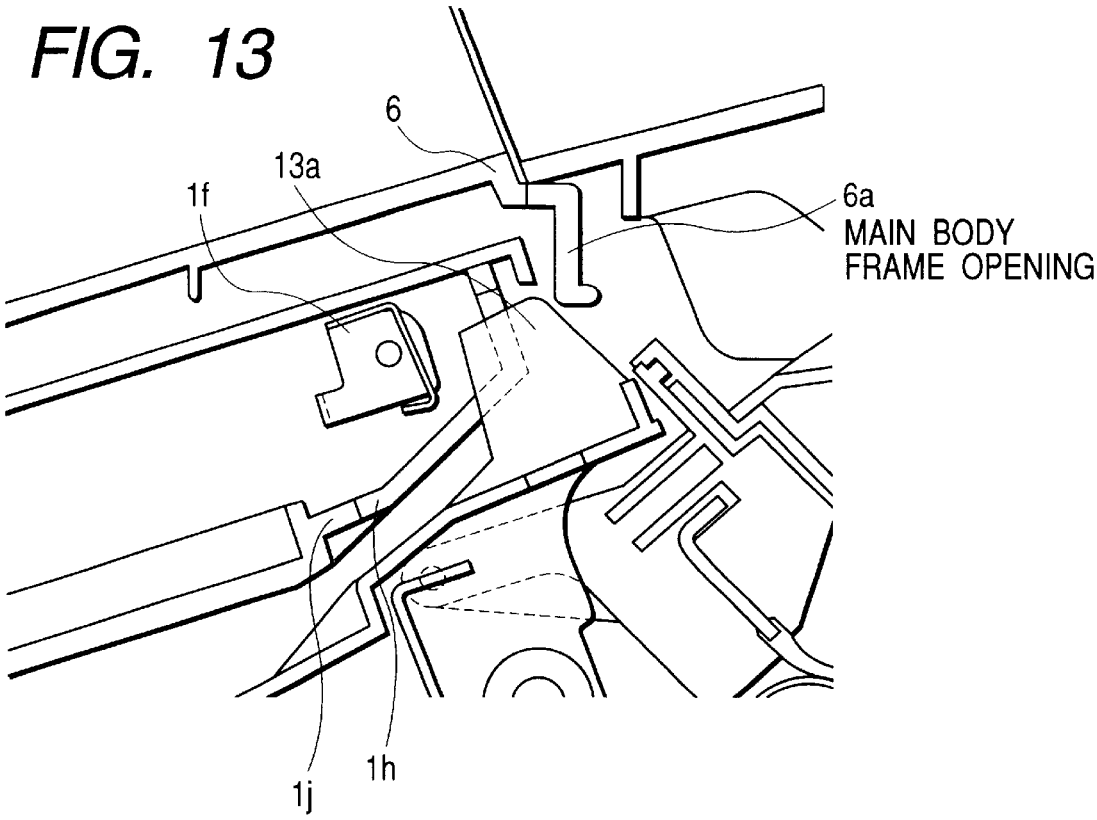
FIGS. 13 and 14 are enlarged longitudinal cross-sectional views illustrating how to attach the process cartridge to the image forming apparatus.

The process cartridge E as shown in FIG. 4, is attached to the main body 22 of the image forming apparatus from a direction (the direction of arrow X) intersecting with the axial direction of the electrophotographic photosensitive member. Next, as shown in FIG. 13, the projection 13*a* passes through an opening 6*a* in a main body formed at a location corresponding to the projection 13*a* provided on the process cartridge E, and an opening 1*h* in the frame of the laser scanner 1. An opening 6*a* in the main body frame and the opening 1*h* in the frame of the laser scanner 1 are narrow openings and prevent the malfunctioning or the like of the laser shutter 1*f*.

Figure 14:
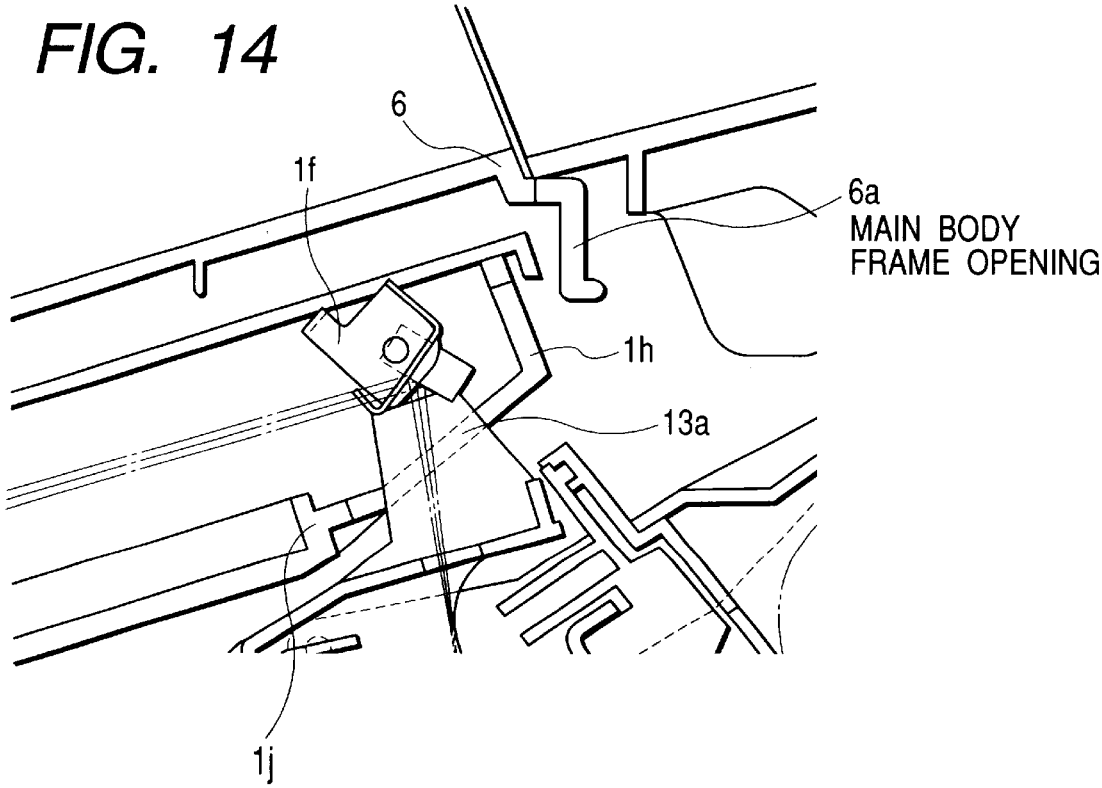

Further, as shown in FIG. 14, the corner portion and upper portion of the tip end of the projection 13*a* abut against the abutting portion 1*fa* of the laser shutter 1*f* to thereby move the laser shutter 1*f* to a retracted position for opening a laser optical path. As shown in FIG. 1, the process cartridge E is then attached to the main body of the image forming apparatus, and the laser beam becomes capable of being applied to the photosensitive drum 7.

Also, when the process cartridge E is pulled out, the laser shutter 1*f* is returned to a position for closing the optical path by the force of a spring (not shown) (the state of FIG. 4).

Figure 5:
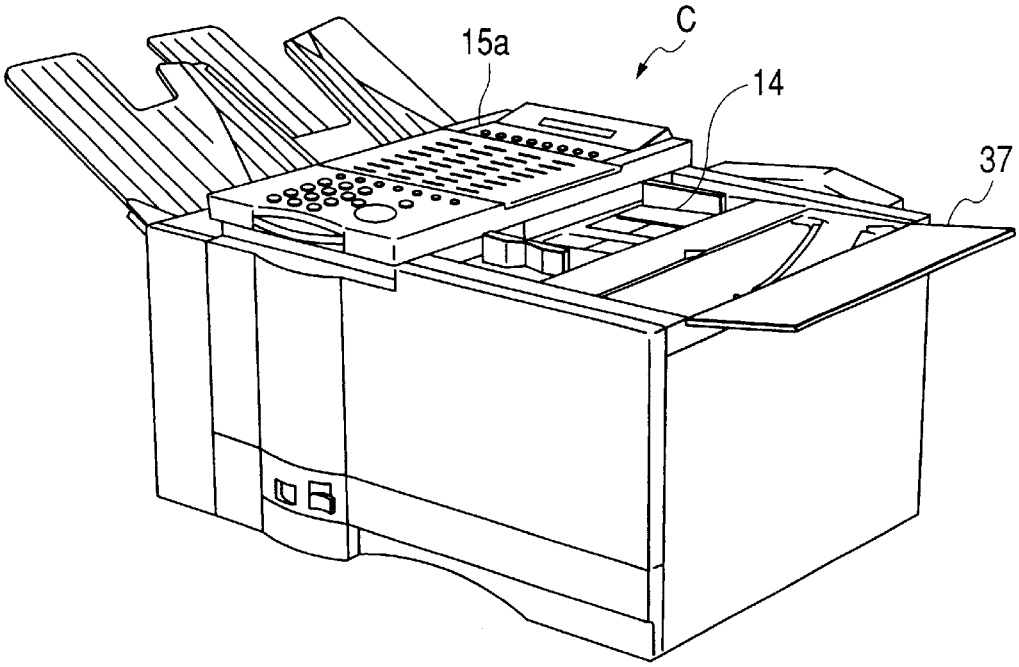
FIG. 5 is a perspective view of a copying machine.
Figure 6:
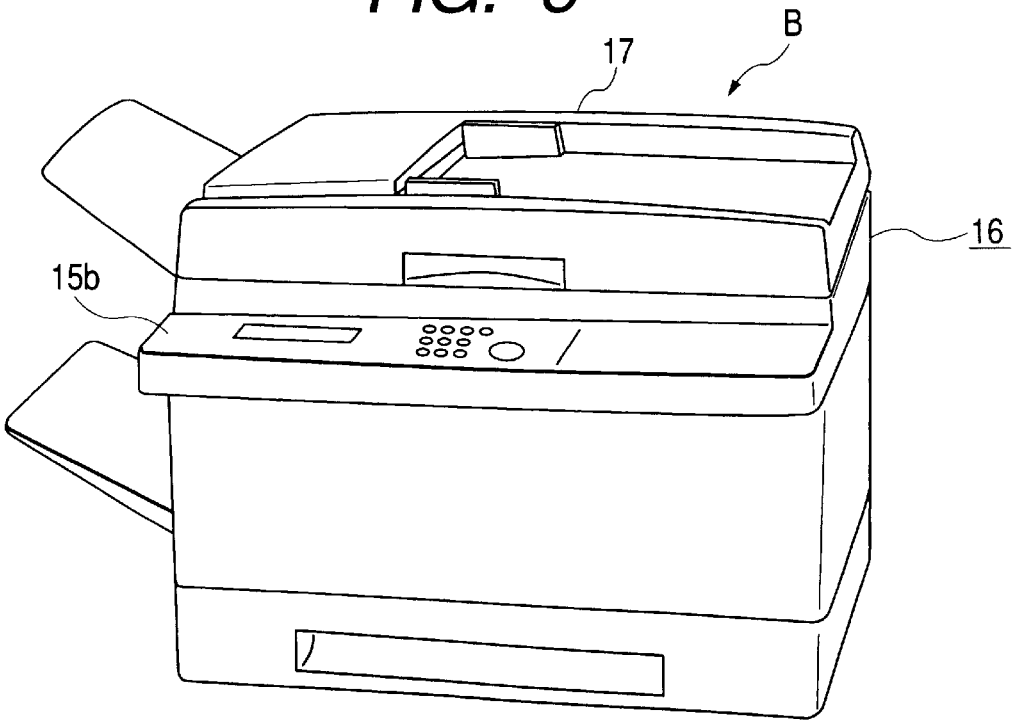
FIG. 6 is a perspective view of the copying machine.
Figure 7:
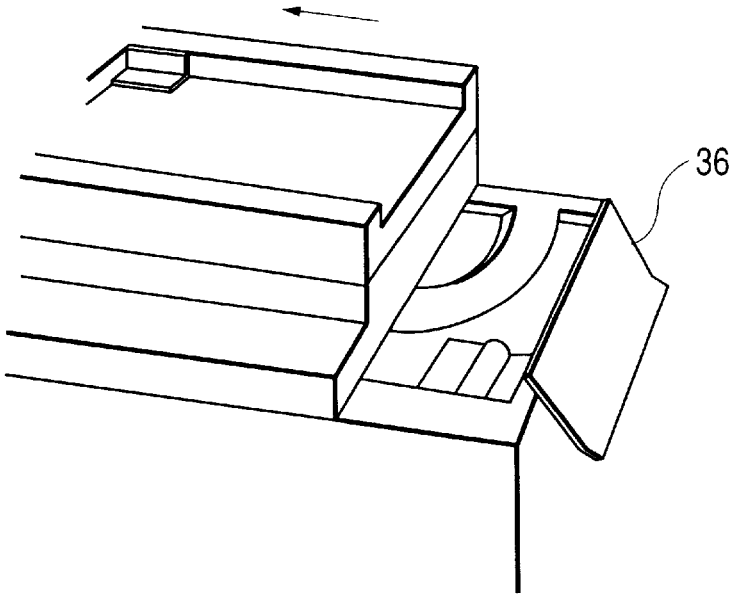
FIG. 7 is a perspective view showing the interchange of the process cartridge of the copying machine.

Now, as previously described, in recent years, it has often become the case that the image forming portions of a copying machine, a laser beam printer and a facsimile apparatus are made common to one another. By making them common, many merits such as the shortening of the period for developing products, improved reliability and the curtailment of cost are expected. The forms of an image forming apparatus according to the embodiment, as shown in FIGS. 5 to 8, include a facsimile apparatus C in which, with a laser beam printer A shown in FIG. 8 as a basic form, a sheet-through type original reading apparatus 14 and a control panel 15*a* are added to the upper portion as shown in FIG. 5, and which is provided with facsimile controlling means having the communicating function and a page memory therein, and a digital copying machine B in which as shown in FIG. 6, an original supporting type original reading apparatus 16, automatic original feeding means 17 and a control panel 15*b* are added to the upper portion and which is provided with control means for the copying machine therein. In the copying machine B, the attachment and detachment of the process cartridge P are effected by sliding the original reading apparatus 16 and the automatic original feeding means 17 in the upper portion in the direction of arrow as shown in FIG. 7 and opening an openable and closable member 36. Also, the attachment and detachment of the process cartridge of the facsimile apparatus C are effected by opening an openable and closable member 37.

The laser beam printer A does not have the toner remaining amount detecting function, while the copying machine B and the facsimile apparatus C have the toner remaining amount detection function set therein. Accordingly, it is necessary to prevent the copying machine B and the facsimile apparatus C from being wrongly mounted on the main body of the apparatus. Also, conversely, there is a case where it becomes necessary to make it impossible for the process cartridge P for the copying machine B to be attached to the main body of the laser beam printer A.

Figure 15:
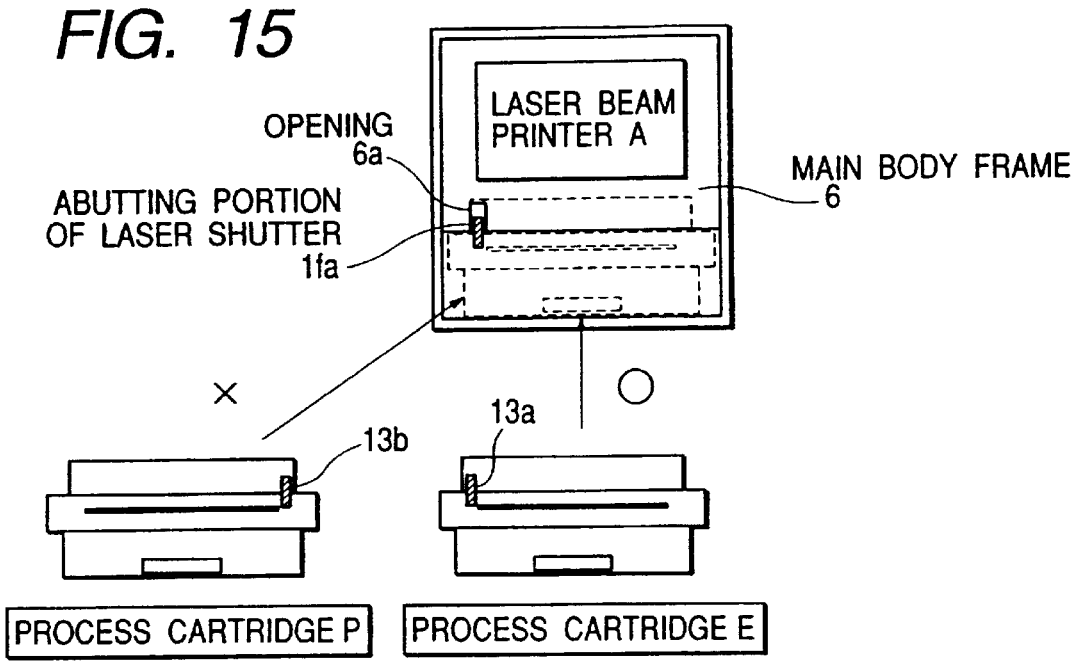
FIG. 15 shows the relation between the attachment of a process cartridge P and the attachment of a process cartridge E to a laser beam printer A.
Figure 16:
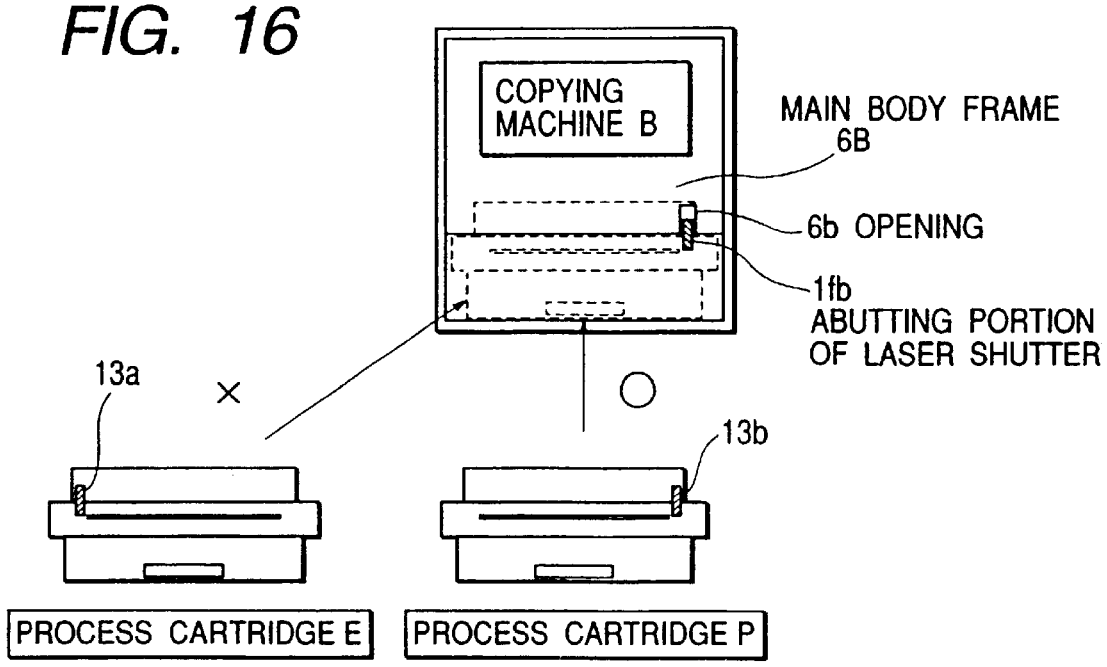
FIG. 16 shows the relation between the attachment of the process cartridge P and the attachment of the process cartridge E to a copying machine B.

So, an abutting portion 1*fb* for pivotally moving the laser shutter of the laser scanner of the copying machine B is disposed at a location differing from that of the abutting portion 1*fa* of the laser beam printer A (FIGS. 15 and 16). Correspondingly, as shown in FIGS. 9 and 10, the projection 13*b* of the process cartridge P is disposed on the left side, and the projection 13*a* of the process cartridge E is disposed on the right side. This difference between the process cartridges E and P is apparently the difference between the locations of the projection 13*a* and the projection 13*b*, and that the process cartridge E does not have an antenna rod 9*a* for detecting the remaining amount of toner, but the process cartridge P has it mounted thereon as shown in FIG. 3. Consequently, when the process cartridge E is to be attached to the laser beam printer A, the projection 13*a* can pass through an opening 6*a* in the main body frame 6 and thus, the process cartridge E is attachable. However, when the process cartridge P is to be attached to the laser beam printer A, the projection 13*b* abuts against the main body frame 6 and the process cartridge P cannot be attached.

Also, when, as shown in FIG. 16, an attempt is made to wrongly attach the process cartridge E to the copying machine B, the projection 13*a* bumps against the frame 6B of the copying machine B in the course of attachment and the process cartridge E cannot enter any further. So, the operator can visually confirm that the projection 13*a* has bumped against the frame 6B, and becomes aware that he has tried to attach a wrong process cartridge. Consequently, it is easier to detect an error than to make the operator aware of wrong insertion because of the openable and closable cover being not closable after the process cartridge E has been completely inserted. Further, according to the method of making the operator aware of wrong insertion because of the openable and closable cover being not closable, there is a risk that the operator, without knowing so, will try to forcibly close the openable and closable cover to thereby destroy a lock mechanism. Therefore, it will be necessary to make the lock mechanism and the openable and closable cover and the hinge thereof stoutly. The present invention is easy for the operator to know and therefore there is not the necessity thereof, and can realize non-interchangeability by a simple construction and further, can reduce the cost.

Also, the projection 13*a* also functions to move the laser shutter 1*f* to a retracted position for opening the laser optical path, and non-interchangeability can be realized by such a simple construction in which provision is made of the projection 13*a* protruded upwardly from the cleaning frame.

Figure 17:
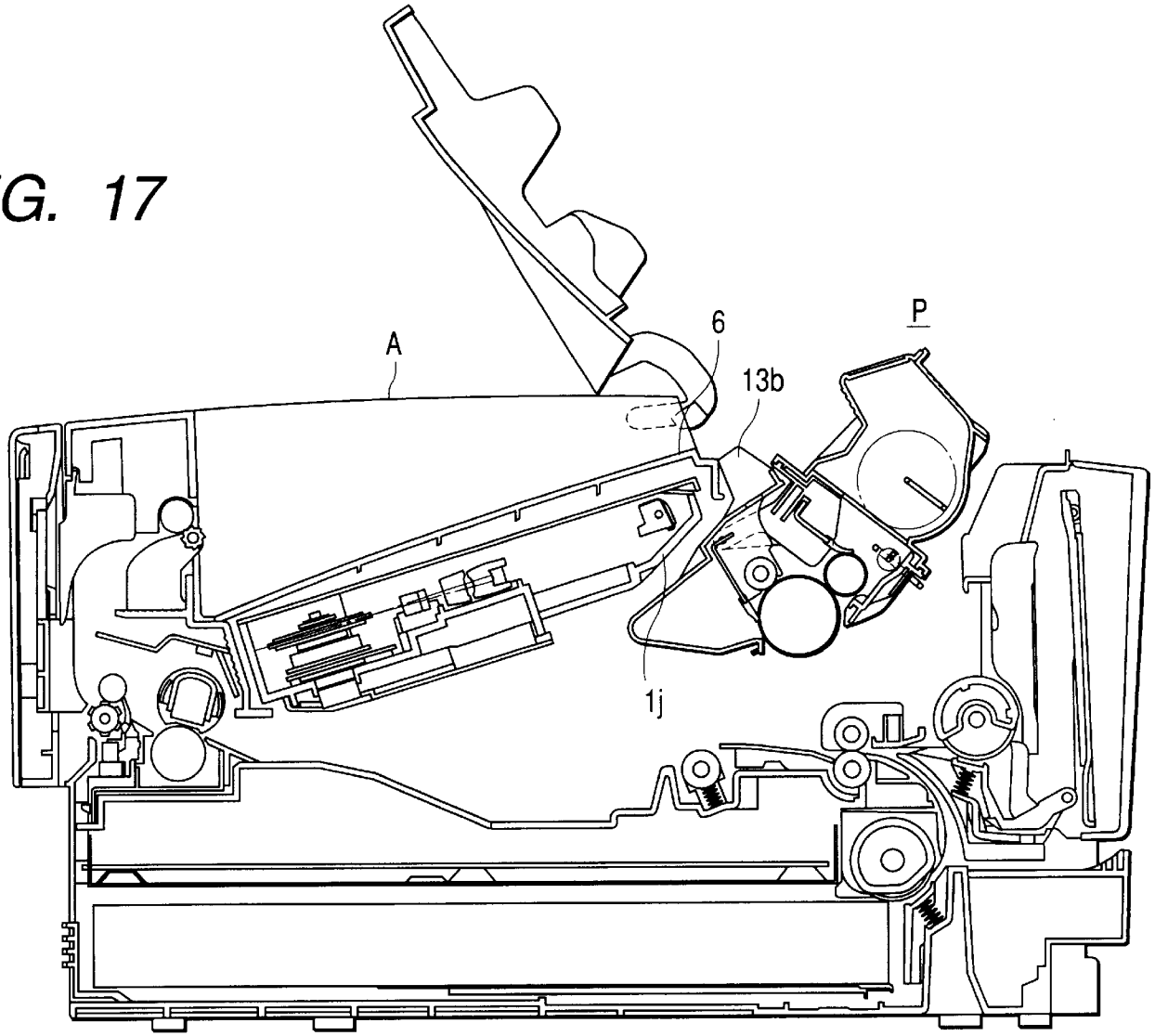
FIG. 17 is a longitudinal cross-sectional view showing the process cartridge P as it has been attached to an image forming apparatus A in the present invention.

Also, in the present embodiment, if the operator attempts to wrongly attach the process cartridge P to the laser beam printer A, the projection 13*b* abuts against the main body frame 6, as shown in FIGS. 15 and 17, and the process cartridge P cannot be inserted any further. At this time, the operator can visually confirm that the projection 13*b* is abutting against the frame 6 and thus, quickly becomes aware that he has attached a wrong process cartridge. Also, this time, the design is made such that the projection 13*b* abuts against the main body frame 6, but alternatively, the design may be made such that the projection 13*b* abuts against a scanner frame 1*j* or other cover or the like.

In addition, in the main body of the image forming apparatus as well, it is not necessary to take the trouble to pre-mount a toner remaining amount detecting device which may lead to an increased cost, for example, on a laser beam printer which does not require the toner remaining amount detecting device for the purpose of making it common, and a reduction in cost can be achieved.

Figure 18:
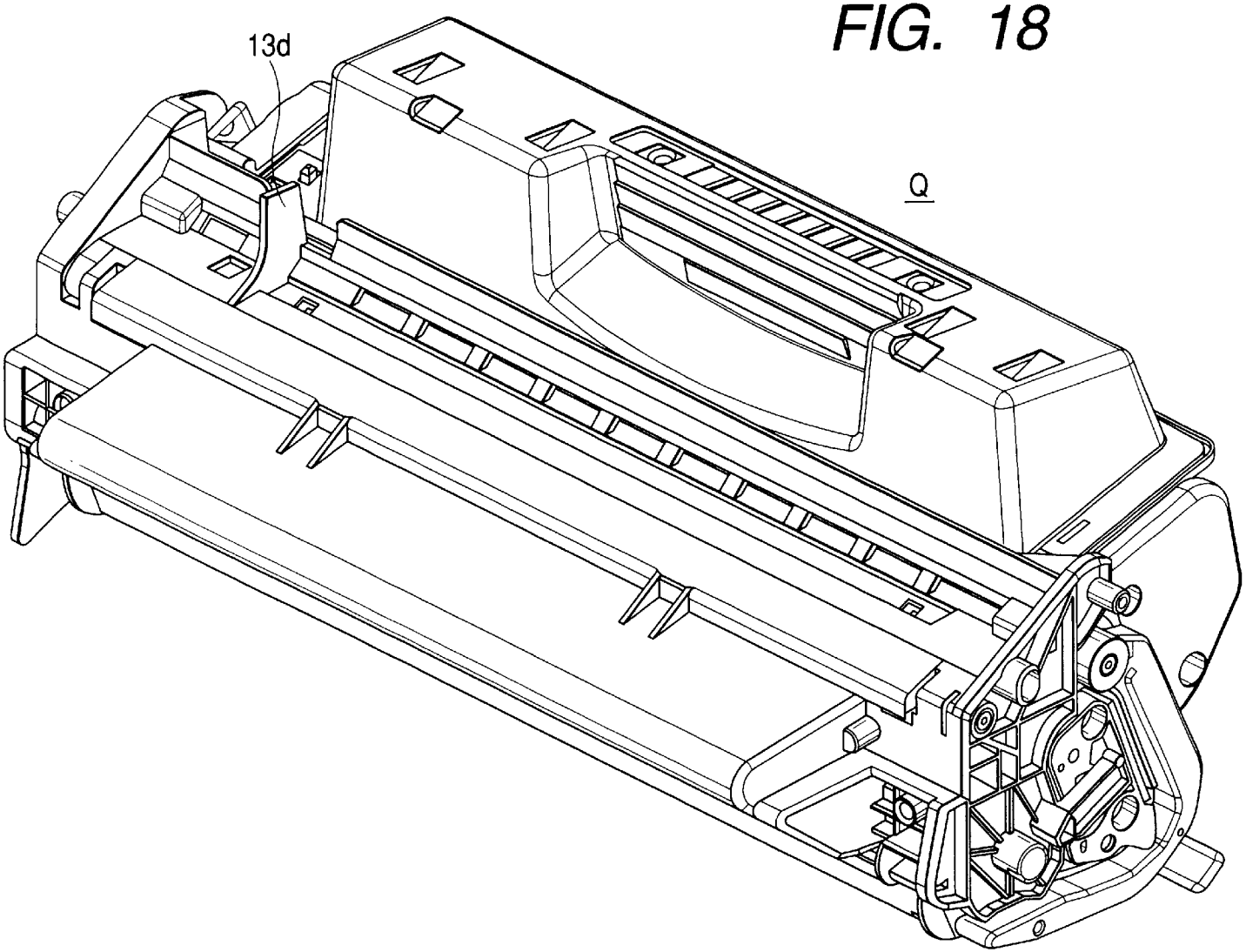
FIG. 18 is a perspective view of a process cartridge Q used in another functionally different image forming apparatus.

Also, this time, the projection 13*a* and the projection 13*b* are disposed at one end side and the other end side of the exposure opening 1*g* in the axial direction of the drum. However, when it becomes necessary to newly prevent a functionally different process cartridge from being attached, like a process cartridge Q shown in FIG. 18, a projection 13*d* can also provided at the same other end side of the exposure opening 1*g* in the axial direction of the drum as in the process cartridge P at a location differing from that of the projection 13*b*. Also, the projection 13*a*, the projection 13*b* and the projection 13*d* hitherto shown may be disposed at intervals from or astride the exposure opening from the relations of the necessary length of the exposure opening and the scanner shutter abutting position.

(Recycling Method for the Process Cartridge)

A description will now be made of a recycling method for the process cartridge according to the present invention. First, a used process cartridge is collected and assorted by kind. Next, the cleaning frame 13 supporting the photosensitive drum 7, the electrifying roller 8, the cleaning blade 10*a*, etc., is separated from the process cartridge, which is thus divided into the cleaning frame 13 and toner and developing units. This separation is effected by inserting arms 23 provided on the lengthwisely opposite ends of the developing frame 12 into the cleaning frame 13 and removing a pin 24 by which the frames 12 and 13 are engaged with each other.

Figure 11:
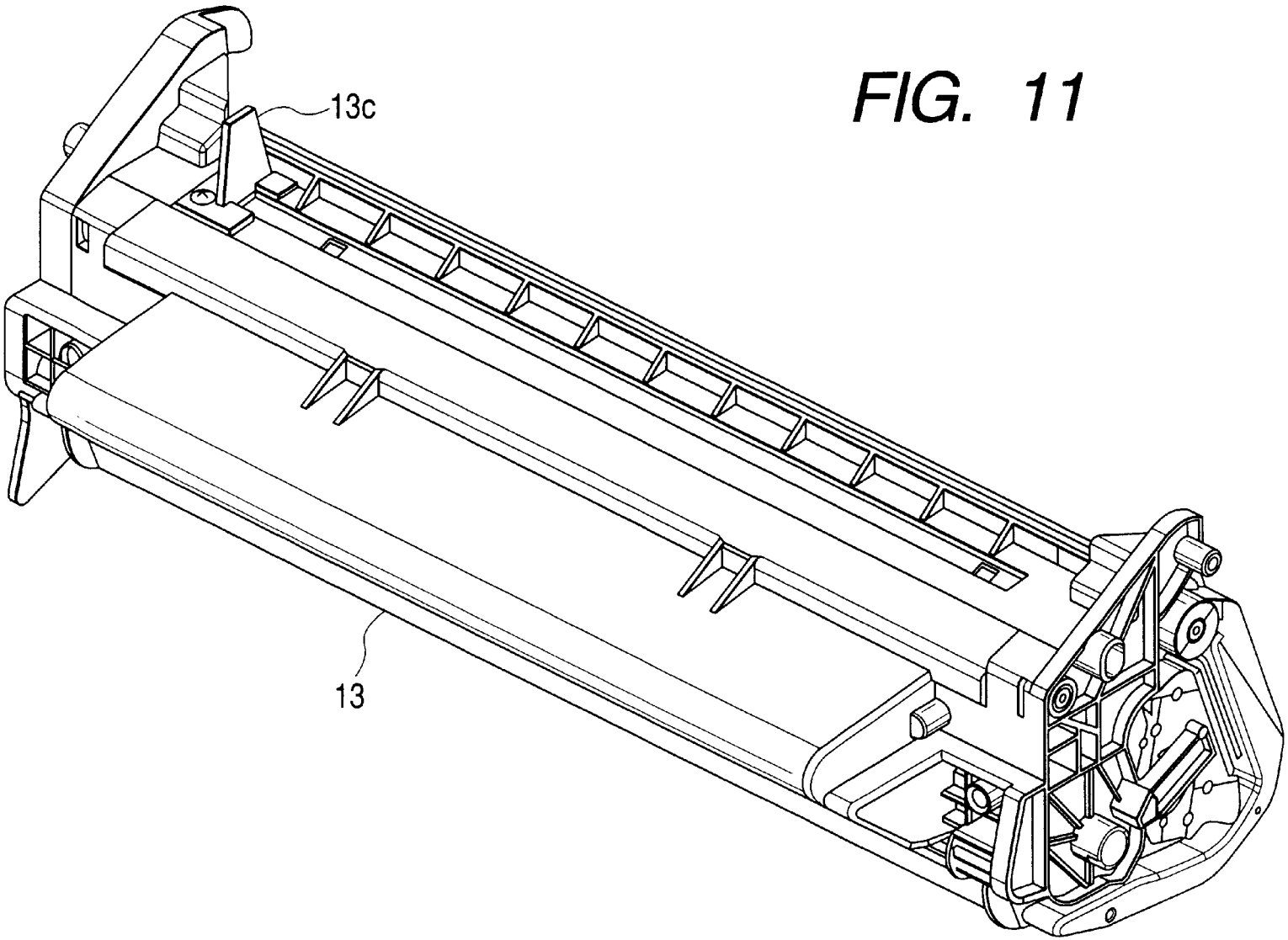
FIG. 11 is a perspective view of the cleaning frame of the process cartridge.

So, the photosensitive drum 7 and the cleaning blade 10*a* are first detached from the cleaning frame 13, and the removed toner therein is discarded, and the cleaning frame 13 cleaned. Next, as shown in FIG. 11, the projection 13*a* of the cleaning frame 13 is cut off, and a projected member 13*c* of the same shape as the cut-off projection is prepared and mounted at the same location as the location of the projection 13*b* of the process cartridge P as by screwing or heat caulking. Thereafter, a new cleaning blade and a new photosensitive drum 7 are mounted.

Figure 12:
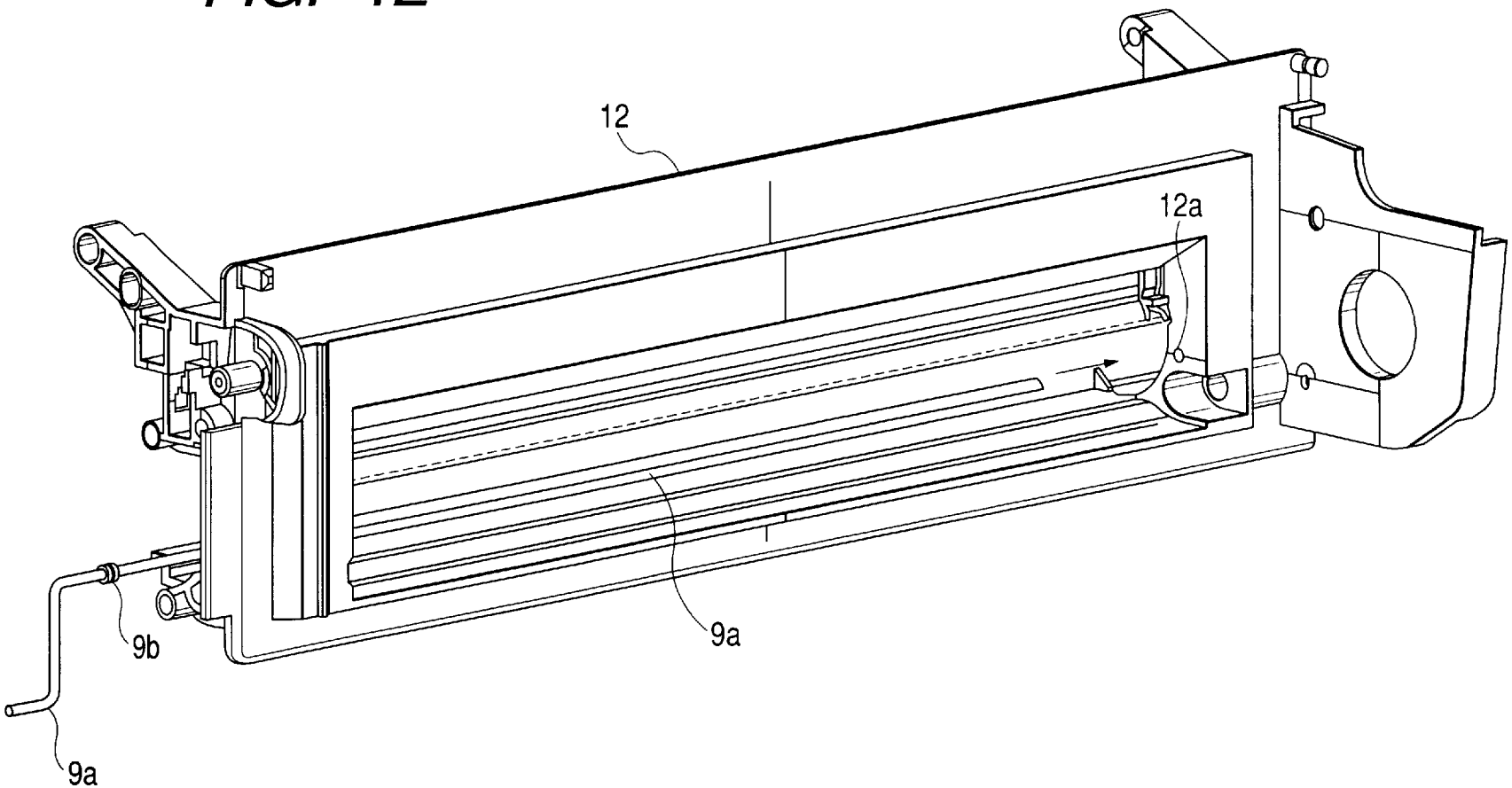
FIG. 12 is a perspective view illustrating how to insert an antenna rod into the developing frame of the process cartridge.

Next, the developing frame 12 and the toner frame 11 are cut and separated from each other. A seal member is stuck on the opening portion of the toner frame 11, which is thus re-sealed. A fresh toner is supplied through the toner supply port, not shown, of the toner frame 11, and then the toner supply port is sealed. Next, a seal member (not shown) made of woolen felt, elastomer or the like and attached to a hole, into which the antenna rod 9*a* for the detection of the remaining amount of toner present on the developing frame 12 is to be inserted, is detached, and as shown in FIG. 12, the antenna rod 9*a* is inserted in the direction of the arrow. A hole 12*a* for supporting the antenna rod 9*a* is pre-formed in an inner wall on the opposite side into which the antenna rod 9*a* of the developing frame 12 has been inserted, and the antenna rod 9*a* can be mounted by being simply inserted into the hole 12*a*. This hole 12*a* is a blind hole. At this time, a cylindrical seal member 9*b* made of ethylene, elastomer or the like is attached to the antenna rod 9*a* to seal the gap between the antenna rod 9*a* and the insertion hole 12*a* and is inserted together. Thereafter, the toner frame 11 and the developing frame 12 are re-coupled together by a coupling member such as a clip or means such as adhesive securing.

As described above, the developing frame 12 of the process cartridge E is also formed with a hole (not shown) for mounting the antenna rod 9*a* therethrough and a blind hole 12*a*. Thereby, the parts of two kinds of process cartridges can be made common to each other.

Lastly, the cleaning frame 13 on which the photosensitive drum 7, the cleaning blade 10*a* and the projecting member 13*c* have been newly mounted is united with the developing unit having the toner frame and the developing frame re-coupled together.

In this manner, the used process cartridge E for the laser beam printer A can be simply recycled into a process cartridge P for the copying machine. Also, when the converse recycling is to be done, the cutting-off of the projection 13*b* of the cleaning frame 13 and the attachment of the projected member 13*c* which is a discrete member can only be effected. The antenna rod 9*a* is mounted on the process cartridge P from the first, but when the process cartridge P is to be used in the laser beam printer, it is affected in no way because there is no contact for receiving a signal from the antenna rod 9*a* on the main body side of the printer. Accordingly, there will be no problem even if the antenna rod 9*a* is left as it is.

The disassembling method and re-assembling method for the process cartridge described above are an example. As another method, there is included a case where the process cartridge is not disassembled, but is refilled through the toner supply port (if it is not exposed outside, it is provided with an aperture), and recycling in which the location of the projection for operating the laser shutter is changed when the process cartridge is to be made reusable is all included.

The aforedescribed embodiment includes a case where used process cartridges are collected and disassembled, and the same parts detached from the respective process cartridges by the disassembling are gathered, whereafter by the use of those parts, or in some cases, by the use of new parts (parts not reused) for some parts, the process cartridge is recycled by the aforedescribed recycling method. The aforedescribed embodiment also includes a case where used process cartridges are collected and disassembled, and by the use of parts detached from the cartridge, or in some cases, by the use of new parts (parts not reused) for some parts or parts detached from other process cartridges, the process cartridge is recycled by the aforedescribed recycling method.

As described above, the process cartridge E of the present embodiment is a process cartridge E detachably attachable to the main body A of an electrophotographic image forming apparatus having a laser beam applying member, a shutter 1*f* for intercepting the optical path of a laser beam emitted from the laser beam applying member, a main body abutting portion 1*fa* for moving the shutter 1*f* to a retracted position retracted from an intercepting position for intercepting the optical path, a main body frame 6 provided upstream of the shutter with respect to the attachment direction of the process cartridge, and an opening portion provided in the main body frame, the process cartridge E having:

an electrophotographic photosensitive drum 7;

process means for acting on the electrophotographic photosensitive drum; and a cartridge abutting portion 13*a* adapted, when the process cartridge E is to be attached to the main body B of an electrophotographic image forming apparatus functionally differing from the main body A of the image forming apparatus, to abut against a main body frame 6B provided in the main body of the functionally different image forming apparatus to thereby block the attachment of the process cartridge, and when the process cartridge is to be attached to the main body A of the image forming apparatus, to pass through the opening portion 6*a* and abut against the main body abutting portion 1*fa* to thereby move the shutter 1*f* to the retracted position.

Also, according to the present embodiment, the projection 13*a* provided on the process cartridge E, when the process cartridge E is to be attached to the main body of an image forming apparatus (copying machine B) functionally differing from the main body of the image forming apparatus of a laser beam printer A, abuts against the main body frame 6B provided in the main body of the functionally different image forming apparatus. When the process cartridge is to be attached to the main body of the image forming apparatus of the laser beam printer A, the projection 13*a* passes through the opening portion 6*a* provided in the main body of the laser beam printer A and abuts against the abutting portion 1*fa* of the laser shutter 1*f* to thereby move the laser shutter 1*f* to the retracted position and open the optical path.

Consequently, the projection 13*a* can have both the function of non-interchange and the function of abutting the abutting portion 1*fa* of the laser shutter 1*f* to thereby move the laser shutter 1*f* to the retracted position, and the use of a functionally different process cartridge and the attachment of the process cartridge to the main body of a functionally different image forming apparatus can be obviated by a simple construction.

Also, by the projection 13*a* being provided upwardly protrudedly from the cleaning frame at one end portion of the exposure opening 1*g* in the axial direction of the photosensitive drum 7, when the operator tries to wrongly attach the process cartridge E to a functionally different image forming apparatus, the projection 13*a* abuts against the main body B of the functionally different image forming apparatus at a visually confirmable position, whereby the operator can be quickly made aware of wrong attachment.

Consequently, as described above, the present invention can o prevent a process cartridge from being wrongly attached to the main body of a functionally different electronic image forming apparatus. Also, the cartridge abutting portion provided on the process cartridge can have both of the function of moving the laser shutter to the retracted position for opening the laser optical path and the function of preventing the process cartridge from being wrongly attached to the main body of a functionally different image forming apparatus. Also, when the operator tries to attach a process cartridge to a functionally different electrophotographic image forming apparatus, the cartridge abutting portion abuts against a main body frame provided on the main body of the functionally different image forming apparatus to thereby enable the operator to visually confirm wrong attachment.

What is claimed is:

1. A process cartridge detachably attachable to a main body of an electrophotographic image forming apparatus having a laser beam applying member, a shutter configured and positioned to shut off an optical path of a laser beam emitted from the laser beam applying member, a main body abutting portion configured and positioned to move the shutter to a retracted position retracted from a shutting-off position for shutting off the optical path, a main body frame provided upstream of the shutter with respect to an attachment direction of the process cartridge, and an opening portion provided in the main body frame, said process cartridge comprising:

an electrophotographic photosensitive drum;

process means for acting on said electrophotographic photosensitive drum; and a cartridge abutting portion adapted, when said process cartridge is to be attached to the main body of a functionally different electrophotographic image forming apparatus functionally differing from the main body of the electrophotographic image forming apparatus, to abut against a main body frame provided on the main body of the functionally different electrophotographic image forming apparatus to thereby block the attachment of said process cartridge, and when said process cartridge is to be attached to the main body of the electrophotographic image forming apparatus, to pass through the opening portion and abut against the main body abutting portion to thereby move the shutter to the retracted position.

2. A process cartridge according to claim 1, wherein said cartridge abutting portion is a projection protruding upwardly from a frame of said process cartridge in a state in which said process cartridge is attached to the main body of the electrophotographic image forming apparatus.

3. A process cartridge according to claim 1, wherein when said process cartridge is to be attached to the main body of the functionally different electrophotographic image forming apparatus functionally differing from the main body of the electrophotographic image forming apparatus, said cartridge abutting portion is provided at a location enabling visual confirmation of a state in which the main body frame provided on the main body of the functionally different image forming apparatus and said cartridge abutting portion abut against each other.

4. A process cartridge according to claim 1, further comprising an exposure opening formed in a frame of said process cartridge to apply the laser beam therethrough to said electrophotographic photosensitive drum, and wherein said cartridge abutting portion is provided at one end side of said exposure opening in the axial direction of said electrophotographic photosensitive drum.

5. A process cartridge according to claim 1, further comprising an exposure opening formed in a frame of said process cartridge to apply the laser beam therethrough to said electrophotographic photosensitive drum, and wherein said cartridge abutting portion is provided at one end side of said exposure opening in the axial direction of said electrophotographic photosensitive drum at an interval from said exposure opening.

6. A process cartridge according to claim 4 or 5, wherein the disposition of said cartridge abutting portion differs from the disposition of a cartridge abutting portion provided on a process cartridge used in the main body of the functionally different image forming apparatus, and the cartridge abutting portion provided on the process cartridge used in the main body of the functionally different image forming apparatus is provided at one end side of an exposure opening formed in the process cartridge used in the main body of the functionally different image forming apparatus in the axial direction of an electrophotographic photosensitive drum of the process cartridge used in the main body of the functionally different image forming apparatus, said one end side of said exposure opening of said process cartridge being at the opposite end from the one end side of the exposure opening of the process cartridge used in the main body of the functionally different image forming apparatus.

7. A process cartridge according to claim 4 or 5, wherein the disposition of said cartridge abutting portion differs from the disposition of a cartridge abutting portion provided on a process cartridge used in the main body of the functionally different image forming apparatus, and the cartridge abutting portion provided on the process cartridge used in the main body of the functionally different image forming apparatus is provided at one end side of an exposure opening formed in the process cartridge used in the main body of the functionally different image forming apparatus in the axial direction of an electrophotographic photosensitive drum of the process cartridge used in the main body of the functionally different image forming apparatus at an interval from the exposure opening formed in the process cartridge used in the main body of the functionally different image forming apparatus, said one end side of said exposure opening of said process cartridge being at the opposite end from the one end side of the exposure opening of the process cartridge used in the main body of the functionally different image forming apparatus.

8. A process cartridge according to claim 4 or 5, wherein the disposition of said cartridge abutting portion differs from the disposition of a cartridge abutting portion provided on a process cartridge used in the main body of the functionally different image forming apparatus, and the cartridge abutting portion provided on the process cartridge used in the main body of the functionally different image forming apparatus is provided at one end side of an exposure opening of the process cartridge used in the main body of the functionally different image forming apparatus in the axial direction of an electrophotographic photosensitive drum of the process cartridge used in the main body of the functionally different image forming apparatus.

9. A process cartridge according to claim 4 or 5, wherein the disposition of said cartridge abutting portion differs from the disposition of a cartridge abutting portion provided on a process cartridge used in the main body of the functionally different image forming apparatus, and the cartridge abutting portion provided on the process cartridge used in the main body of the functionally different image forming apparatus is provided at one end side of an exposure opening of the process cartridge used in the main body of the functionally different image forming apparatus in the axial direction of an electrophotographic photosensitive drum of the process cartridge used in the main body of the functionally different image forming apparatus at an interval from the exposure opening of the process cartridge used in the main body of the functionally different image forming apparatus.

10. A process cartridge according to claim 1, where the main body of the electrophotographic image forming apparatus is an electrophotographic printer and the main body of the functionally different image forming apparatus is an electrophotographic printer, an electrophotographic copying machine, or an electrophotographic facsimile machine.

11. An electrophotographic image forming apparatus for permitting a process cartridge to be detachably attached thereto and forming an image on a recording medium, comprising:

(i) a laser beam applying member;

(ii) a shutter configured and positioned to shut off an optical path of a laser beam emitted from said laser beam applying member;

(iii) a main body abutting portion configured and positioned to move said shutter to a retracted position from a shutting-off position for shutting off the optical path;

(iv) a main body frame provided upstream of said shutter with respect to an attachment direction of the process cartridge;

(v) an opening portion provided in said main body frame;

(vi) attaching means for detachably attaching a process cartridge having an electrophotographic photosensitive drum, process means for acting on the electrophotographic photosensitive drum, and a cartridge abutting portion adapted, when the process cartridge is to be attached to a main body of a functionally different electrophotographic image forming apparatus functionally differing from a main body of said electrophotographic image forming apparatus, to abut against a main body frame provided on the functionally different electrophotographic image forming apparatus to thereby block the attachment of the process cartridge, and when the process cartridge is to be attached to said main body, to pass through said opening portion and abut against said main body abutting portion to thereby move said shutter to said retracted position; and (vii) conveying means for conveying the recording medium.

12. An electrophotographic image forming apparatus according to claim 11, wherein said main body of said electrophotographic image forming apparatus is an electrophotographic printer and the main body of the functionally different image forming apparatus is an electrophotographic printer, an electrophotographic copying machine, or an electrophotographic facsimile machine.

13. An electrophotographic image forming system, comprising a process cartridge and an electrophotographic image forming apparatus, for attaching said process cartridge to a main body of said electrophotographic image forming apparatus, and forming an image on a recording medium, said main body of said image forming apparatus comprising:

a laser beam applying member;

a shutter configured and positioned to shut off an optical path of a laser beam emitted from said laser beam applying member;

a main body abutting portion configured and positioned to move said shutter to a retracted position retracted from a shutting-off position for shutting off the optical path;

a main body frame provided upstream of said shutter with respect to an attachment direction of the process cartridge;

an opening portion provided in said main body frame;

attaching means for detachably attaching said process cartridge; and conveying means for conveying the recording medium;

said process cartridge comprising:

an electrophotographic photosensitive drum;

process means for acting on said electrophotographic photosensitive drum; and a cartridge abutting portion adapted, when said process cartridge is to be attached to a main body of an electrophotographic image forming apparatus functionally differing from said main body of said electrophotographic image forming apparatus, to abut against a main body frame provided on the main body of said functionally different electrophotographic image forming apparatus to thereby block the attachment of said process cartridge, and when said process cartridge is to be attached to said main body of said electrophotographic image forming apparatus, to pass through said opening portion and abut against said main body abutting portion to thereby move said shutter to the retracted position.

14. An electrophotographic image forming system according to claim 13, wherein said cartridge abutting portion is a projection protruding upwardly from a frame of said process cartridge in a state in which said process cartridge is attached to said main body of said electrophotographic image forming apparatus.

15. An electrophotographic image forming system according to claim 13, wherein when said process cartridge is to be attached to the main body of the functionally different electrophotographic image forming apparatus functionally differing from said main body of said electrophotographic image forming apparatus, said cartridge abutting portion is provided at a location enabling visual confirmation of a state in which the main body frame provided on the main body of the functionally different image forming apparatus and said cartridge abutting portion abut against each other.

16. An electrophotographic image forming system according to claim 13, wherein said process cartridge has an exposure opening formed in a frame of said process cartridge to apply the laser beam therethrough to said electrophotographic photosensitive drum, and said cartridge abutting portion is provided at one end side of said exposure opening in the axial direction of said electrophotographic photosensitive drum.

17. An electrophotographic image forming system according to claim 13, wherein said process cartridge has an exposure opening formed in a frame of said process cartridge to apply the laser beam therethrough to said electrophotographic photosensitive drum, and said cartridge abutting portion is provided at one end side of said exposure opening in the axial direction of said electrophotographic photosensitive drum at an interval from said exposure opening.

18. An electrophotographic image forming system according to claim 16 or 17, wherein the disposition of said cartridge abutting portion differs from the disposition of a cartridge abutting portion provided on a process cartridge used in the main body of the functionally different image forming apparatus, and a cartridge abutting portion provided on the process cartridge used in the main body of the functionally different image forming apparatus is provided at an end side of an exposure opening formed in the process cartridge used in the main body of the functionally different image forming apparatus in the axial direction of an electrophotographic photosensitive drum of the process cartridge used in the main body of the functionally different image forming apparatus, said one end side of said exposure opening of said process cartridge being at the opposite end from the end side of the exposure opening of the process cartridge used in the main body of the functionally different image forming apparatus.

19. An electrophotographic image forming system according to claim 16 or 17, wherein the disposition of said cartridge abutting portion differs from the disposition of a cartridge abutting portion provided on a process cartridge used in the main body of the functionally different image forming apparatus, and a cartridge abutting portion provided on the process cartridge used in the main body of the functionally different image forming apparatus is provided at an end side of an exposure opening formed in the process cartridge used in the main body of the functionally different image forming apparatus in the axial direction of the electrophotographic photosensitive drum of the process cartridge used in the main body of the functionally different image forming apparatus at an interval from the exposure opening formed in the process cartridge used in the main body of the functionally different image forming apparatus, said one end side of said exposure opening of said process cartridge being at the opposite end from the end side of the exposure opening of the process cartridge used in the main body of the functionally different image forming apparatus.

20. An electrophotographic image forming system according to claim 16 or 17, wherein the disposition of said cartridge abutting portion differs from the disposition of a cartridge abutting portion provided on a process cartridge used in the main body of the functionally different image forming apparatus, and the cartridge abutting portion provided on the process cartridge used in the main body of the functionally different image forming apparatus is provided at one end side of an exposure opening of the process cartridge used in the main body of the functionally different image forming apparatus in the axial direction of an electrophotographic photosensitive drum of the process cartridge used in the main body of the functionally different image forming apparatus.

21. An electrophotographic image forming system according to claim 16 or 17, wherein the position of said cartridge abutting portion differs from the position of a cartridge abutting portion provided on a process cartridge used in the main body of the functionally different image forming apparatus, and the cartridge abutting portion provided on the process cartridge used in the main body of the functionally different image forming apparatus is provided at one end side of an exposure opening of the process cartridge used in the main body of the functionally different image forming apparatus in the axial direction of an electrophotographic photosensitive drum of the process cartridge used in the main body of the functionally different image forming apparatus at an interval from the exposure opening of the process cartridge used in the main body of the functionally different image forming apparatus.

22. An electrophotographic image forming system according to claim 13, wherein said main body of said electrophotographic image forming apparatus is an electrophotographic printer and the main body of the functionally different image forming apparatus is an electrophotographic printer, an electrophotographic copying machine, or an electrophotographic facsimile machine.

23. A process cartridge detachably attachable to a main body of an electrophotographic image forming apparatus having a scanner unit having a laser beam applying member, a shutter configured and positioned to shut off an optical path of a laser beam emitted from the laser beam applying member, and a main body abutting portion configured and positioned to move the shutter to a retracted position from a shutting-off position for shutting off the optical path, wherein the electrophotographic image forming apparatus also has a main body frame provided upstream of the scanner unit with respect to an attachment direction of said process cartridge, a first opening portion provided in the main body, a second opening portion provided in the scanner unit, and a main body guide portion, said process cartridge comprising:

an electrophotographic photosensitive drum;

process means for acting on said electrophotographic photosensitive drum;

a cartridge frame;

a cartridge protruding portion provided so as to protrude from said cartridge frame and configured and positioned to guide said process cartridge by engaging with the main body guide portion, when said process cartridge is attached to the main body of the electrophotographic image forming apparatus; and a cartridge abutting portion adapted, (i) when said process cartridge is attached to the main body of the electrophotographic image forming apparatus by engaging said cartridge protruding portion with the main body guide portion, to abut aganist the main body abutting portion in order to move the shutter to the retracted position by passing through the first opening and the second opening following the first opening, and (ii) when said process cartridge is attached to a main body of an electrophotographic image forming apparatus functionally differing from the main body of the electrophotographic image forming apparatus by engaging said cartridge protruding portion with a main body guide portion provided in a main body of the functionally different electrophotographic image forming apparatus, to abut against a main body frame provided in the functionally different electrophotographic image forming apparatus, in the middle of attaching of said process cartridge to the functionally different electrophotographic image forming apparatus, in order to prevent said process cartridge from being attached to the functionally different electrophotographic image forming apparatus.

24. A process cartridge according to claim 23, wherein a leading edge portion and an upper portion of said cartridge abutting portion abut against the shutter to move the shutter to the retracted position, when said process cartridge is attached to the electrophotographic image forming apparatus.

25. A process cartridge according to claim 23, wherein said cartridge protruding portion is a cartridge positioning protrusion portion provided so as to protrude outwardly from a side of said cartridge frame coaxially with an axis of said electrophotographic photosensitive drum in order to position said process cartridge to the main body of the electrophotographic image forming apparatus.

26. A process cartridge according to claim 23, wherein said cartridge abutting portion is a projection protruding upwardly from said cartridge frame in a state in which said process cartridge is attached to the main body of the electrophotographic image forming apparatus.

27. A process cartridge according to claim 23, wherein when said process cartridge is attached to the main body of the functionally different electrophotographic image forming apparatus differing from the main body of the electrophotographic image forming apparatus, said cartridge abutting portion is provided at a location enabling visual confirmation of a state in which the main body frame provided on the main body of the functionally different image forming apparatus and said cartridge abutting portion abut against each other.

28. A process cartridge according to claim 23, further comprising an exposure opening formed in a frame of said process cartridge to apply the laser beam therethrough to said electrophotographic photosensitive drum, and wherein said cartridge abutting portion is provided at one end side of said exposure opening in the axial direction of said electrophotographic photosensitive drum.

29. A process cartridge according to claim 28, wherein the disposition of said cartridge abutting portion differs from the disposition of a cartridge abutting portion provided on a process cartridge used in the main body of the functionally different electrophotographic image forming apparatus, and the cartridge abutting portion provided on the process cartridge used in the main body of the functionally different image forming apparatus is provided at one end side of an exposure opening formed in the process cartridge used in the main body of the functionally different image forming apparatus in the axial direction of an electrophotographic photosensitive drum of the process cartridge used in the main body of the functionally different image forming apparatus, said one end side of said exposure opening of said process cartridge being at the opposite end from the one end side of the exposure opening of the process cartridge used in the main body of the functionally different image forming apparatus.

30. An electrophotographic image forming apparatus for permitting a process cartridge to be detachably attachable thereto and for forming an image on a recording medium, comprising:

(i) a scanner unit having a laser beam apply member, a shutter configured and positioned to shut off an optical path of a laser beam emitted from said laser beam applying member, and a main body abutting portion configured and positioned to move said shutter to a retracted position from a shutting-off position for shutting off the optical path;

(ii) a main body frame provided upstream of said scanner unit with respect to an attachment direction of the process cartridge;

(iii) a first opening portion provided in a main body of said electrophotographic image forming apparatus, (iv) a second opening portion provided in said scanner unit;

(v) a main body guide portion;

(vi) an attachment member configured to detachably attach the process cartridge which includes:

an electrophotographic photosensitive drum, process means for acting on the electrophotographic photosensitive drum, a cartridge frame, a cartridge protruding portion provided so as to protrude from said cartridge frame and configured and positioned to guide the process cartridge by engaging with said main body guide portion, when the process cartridge is attached to said main body of said electrophotographic image forming apparatus, and a cartridge abutting portion adapted (i) when the process cartridge is attached to said main body of said electrophotographic image forming apparatus by engaging the cartridge protruding portion with said main body guide portion, to abut against said main body abutting portion in order to move said shutter to the retracted position by passing through the first opening and the second opening following the first opening, and (ii) when the process cartridge is attached to a main body of an electrophotographic image forming apparatus functionally differing from said main body of said electrophotographic image forming apparatus by engaging the cartridge protruding portion with a main body guide portion provided in a main body of the functionally different electrophotographic image forming apparatus, to abut against a main body frame provided in the functionally different electrophotographic image forming apparatus, in the middle of attaching of the process cartridge to the functionally different electrophotographic image forming apparatus, in order to prevent the process cartridge from being attached to the functionally different electrophotographic image forming apparatus, and (vii) conveying means for conveying the recording medium.

31. An electrophotographic image forming system, comprising a process cartridge and an electrophotographic image forming apparatus having a main body, for attaching said process cartridge to said main body of said electrophotographic image forming apparatus, and forming an image on a recording medium, said main body of said image forming apparatus comprising:

a scanner unit having a laser beam applying member, a shutter configured and positioned to shut off an optical path of a laser beam emitted from said laser beam applying member, and a main body abutting portion configured and positioned to move said shutter to a retracted position from a shutting-off position for shutting off the optical path;

a main body frame provided upstream of said scanner unit with respect to an attachment direction of said process cartridge;

a first opening portion provided in said main body;

a second opening portion provided in said scanner unit; and a main body guide portion, wherein said process cartridge comprises:

an electrophotographic photosensitive drum;

process means for acting on said electrophotographic photosensitive drum;

a cartridge frame;

a cartridge protruding portion provided so as to protrude from said cartridge frame and configured and positioned to guide said process cartridge by engaging with said main body guide portion, when said process cartridge is attached to said main body of said electrophotographic image forming apparatus; and a cartridge abutting portion adapted (i) when said process cartridge is attached to said main body of said electrophotographic image forming apparatus by engaging said cartridge protruding portion with said main body guide portion, to abut aganist said main body abutting portion in order to move said shutter to the retracted position by passing through the first opening and the second opening following the first opening, and (ii) when said process cartridge is attached to a main body of an electrophotographic image forming apparatus functionally differing from the main body of said electrophotographic image forming apparatus by engaging said cartridge protruding portion with a main body guide portion provided in a main body of the functionally different electrophotographic image forming apparatus, to abut against a main body frame provided in the functionally different electrophotographic image forming apparatus, in the middle of attaching of said process cartridge to the functionally different electrophotographic image forming apparatus, in order to prevent said process cartridge from being attached to the functionally different electrophotographic image forming apparatus, and wherein said cartridge abutting portion abuts against said main body abutting portion to move said shutter to the retracted position by passing through the first opening and the second opening following the first opening when said process cartridge is attached to said main body of said electrophotographic image forming apparatus by engaging said cartridge protruding portion with said main body guide portion, and said cartridge abutting portion abuts against a main body frame provided in the functionally different electrophotographic image forming apparatus, in the middle of attaching said process cartridge to the functionally different electrophotographic image forming apparatus, in order to prevent said process cartridge from being attached to the functionally different electrophotographic image forming apparatus, when said process cartridge is to be attached to the main body of the functionally different electrophotographic image forming apparatus functionally different from said main body of said electrophotographic image forming apparatus by engaging said cartridge protruding portion with the main body guide portion provided in the main body of the functionally different electrophotographic image forming apparatus.

* * * * *

UNITED STATES PATENT AND TRADEMARK OFFICE

CERTIFICATE OF CORRECTION

PATENT NO. : 6,826,373 B2
DATED : November 30, 2004
INVENTOR(S) : Yoshiya Nomura It is certified that error appears in the above-identified patent and that said Letters Patent is hereby corrected as shown below:

Title page,
Item [30], Foreign Application Priority Data, "2001/066965 2002/044641"should read -- 2001-066965 2002-044641 --.
Item [56], References Cited, FOREIGN PATENT DOCUMENTS, "59031976" should read -- 59-031976 --.

Column 9,
Line 20, "also" should read -- also be --.

Column 11,
Line 44, "can o" should read -- can --.

Column 12,
Line 2, "of the" should read -- of said --.

Column 18,
Line 14, "apply" should read -- applying --.
Line 25, "apparatus," should read -- apparatus; --.
Line 36, "said" should read -- the --.
Line 41, "adapted" should read -- adapted, --.

Column 19,
Line 35, "adapted" should read -- adapted, --.

Column 20,
Line 17, "and" should be deleted.

Signed and Sealed this

Twenty-second Day of March, 2005

JON W. DUDAS
*Director of the United States Patent and Trademark Office*